US012371632B2

(12) United States Patent
Kaneko et al.

(10) Patent No.: US 12,371,632 B2
(45) Date of Patent: Jul. 29, 2025

(54) ADDITIVE OR COMPOSITION FOR IMPARTING LUBRICITY

(71) Applicant: MIYOSHI OIL & FAT CO., LTD., Tokyo (JP)

(72) Inventors: Kotaro Kaneko, Tokyo (JP); Koji Kawai, Tokyo (JP)

(73) Assignee: MIYOSHI OIL & FAT CO., LTD., Tokyo (JP)

( * ) Notice: Subject to any disclaimer, the term of this patent is extended or adjusted under 35 U.S.C. 154(b) by 0 days.

(21) Appl. No.: 18/434,205

(22) Filed: Feb. 6, 2024

(65) Prior Publication Data

US 2024/0271055 A1 Aug. 15, 2024

Related U.S. Application Data

(63) Continuation of application No. 18/010,684, filed as application No. PCT/JP2021/022604 on Jun. 15, 2021, now abandoned.

(30) Foreign Application Priority Data

Jun. 16, 2020 (JP) ..... 2020-103838
Sep. 23, 2020 (JP) ..... 2020-158169

(51) Int. Cl.

| | |
|---|---|
| ***C10M 141/06*** | (2006.01) |
| ***C10M 125/24*** | (2006.01) |
| ***C10M 125/26*** | (2006.01) |
| ***C10M 129/32*** | (2006.01) |
| ***C10M 129/34*** | (2006.01) |
| ***C10M 129/40*** | (2006.01) |
| ***C10M 129/50*** | (2006.01) |
| ***C10M 133/06*** | (2006.01) |
| ***C10M 133/08*** | (2006.01) |
| ***C10M 135/12*** | (2006.01) |
| ***C10M 141/08*** | (2006.01) |
| ***C10M 169/04*** | (2006.01) |
| ***C10M 173/00*** | (2006.01) |
| *C10N 30/04* | (2006.01) |

(52) U.S. Cl.

CPC ..... *C10M 141/06* (2013.01); *C10M 125/24* (2013.01); *C10M 125/26* (2013.01); *C10M 129/32* (2013.01); *C10M 129/34* (2013.01); *C10M 129/40* (2013.01); *C10M 129/50* (2013.01); *C10M 133/06* (2013.01); *C10M 133/08* (2013.01); *C10M 135/12* (2013.01); *C10M 141/08* (2013.01); *C10M 169/04* (2013.01); *C10M 173/00* (2013.01); *C10M 2201/085* (2013.01); *C10M 2201/087* (2013.01); *C10M 2207/122* (2013.01); *C10M 2207/123* (2013.01); *C10M 2207/126* (2013.01); *C10M 2207/141* (2013.01); *C10M 2215/26* (2013.01); *C10M 2219/06* (2013.01); *C10N 2030/04* (2013.01)

(58) Field of Classification Search

CPC ..... C10N 2030/08; C10N 2030/24; C10N 2050/013; C10N 2030/10; C10N 2040/22; C10N 2030/04; C10N 2030/12; C10N 2030/06; C10M 141/08; C10M 169/04; C10M 125/24; C10M 173/00; C10M 133/08; C10M 133/06; C10M 129/32; C10M 129/50; C10M 141/06; C10M 129/40; C10M 129/34; C10M 135/12; C10M 125/26; C10M 2207/281; C10M 2207/126; C10M 2219/044; C10M 2207/123; C10M 2219/06; C10M 2201/02; C10M 2215/04; C10M 2201/085; C10M 2215/042; C10M 2207/127; C10M 2207/141; C10M 2209/104; C10M 2215/26; C10M 2207/122; C10M 2207/022; C10M 2203/102; C10M 2201/087; C10M 2207/128

See application file for complete search history.

(56) References Cited

U.S. PATENT DOCUMENTS

| | | | |
|---|---|---|---|
| 2010/0227783 | A1 | 9/2010 | Habeeb et al. |
| 2012/0149616 | A1 | 6/2012 | Schmid-Amelunxen et al. |
| 2018/0340129 | A1 | 11/2018 | Wang |

FOREIGN PATENT DOCUMENTS

| | | | |
|---|---|---|---|
| JP | 2006-83378 | A | 3/2006 |
| JP | 2006-290956 | A | 10/2006 |
| JP | 2012-518702 | A | 8/2012 |
| JP | 2013503922 | A | 2/2013 |
| JP | 2014-131974 | A | 7/2014 |
| JP | 2014-131975 | A | 7/2014 |

(Continued)

OTHER PUBLICATIONS

Office Action issued in Chinese Application No. 202180040566.5 on Oct. 31, 2024, with English translation.

(Continued)

*Primary Examiner* — Vishal V Vasisth

(74) *Attorney, Agent, or Firm* — Birch, Stewart, Kolasch & Birch, LLP

(57) ABSTRACT

Provided is a an additive or composition for imparting lubricity which has high lubricity, is excellent in low-corrosion property, low-temperature fluidity, thermal conductivity, thermal stability, and oxidative stability, and has high flashing point. The lubricant according to the present invention is an additive or composition, wherein the following components (A) an amine or an ammonium compound; and (B) an acid or a salt thereof, have been added therein, wherein at least one of the components (A) and (B) contains a hydrogen-bonding functional group.

30 Claims, No Drawings

(56) References Cited

FOREIGN PATENT DOCUMENTS

| | | | |
|---|---|---|---|
| JP | 2015-48366 | A | 3/2015 |
| JP | 2015-124256 | A | 7/2015 |
| JP | 2016-117815 | A | 6/2016 |
| JP | 2016-155982 | A | 9/2016 |
| JP | 2016-155983 | A | 9/2016 |
| WO | WO 2015/175778 | A1 | 1/2015 |

OTHER PUBLICATIONS

Extended European Search Report for European Application No. 21825997.6, dated Jun. 24, 2024.
International Search Report (PCT/ISA/210) issued in PCT/JP2021/022604, dated Sep. 7, 2021.
Written Opinion of the International Searching Authority (PCT/ISA/237) issued in PCT/JP2021/022604, dated Sep. 7, 2021.

ADDITIVE OR COMPOSITION FOR IMPARTING LUBRICITY

This application is a Continuation of application Ser. No. 18/010,684, filed on Dec. 15, 2022, which is the National Stage Application under 35 U.S.C. § 371 of International Application No. PCT/JP2021/022604, filed on Jun. 15, 2021, which claims the benefit under 35 U.S.C. § 119(a) to Japanese Patent Application No. 2020-103838, filed on Jun. 16, 2020 and Japanese Patent Application No. 2020-158169, filed on Sep. 23, 2020, all of which are hereby expressly incorporated by reference into the present application.

TECHNICAL FIELD

The present invention relates to an additive or composition for imparting lubricity.

BACKGROUND ART

Lubricants are used in mechanical moving parts that are in contact with metallic or other components for the purpose of, for example, reducing friction and/or heat, distributing stresses, and/or sealing. Proper lubrication with lubricants allows frictional parts to extend their life expectancy and enables a reduction in energy loss.

The inventors of the present invention proposed an ammonium salt having a hydrogen-bonding functional group(s) in cations or anions, particularly ionic liquids that are liquid at room temperature (Patent documents 1 and 2). They, however, have not considered the application thereof to lubricants. They also proposed an application thereof to ink compositions for writing instruments (Patent documents 3 to 7) and confirmed some advantages regarding writability (e.g., anti-bleeding property, calligraphy faint prevention, long-term stability in discharging performance). However, no characteristics have heretofore been studied for a lubricant that is primarily intended for reducing friction or heat in mechanical moving parts such as characteristics regarding coefficient of kinetic friction, coefficient of static friction, operating temperature range, low-temperature fluidity, thermal conductivity, thermal stability, oxidation stability, and flashing point. Moreover, there has not been studied an advantage of having a hydrogen-bonding functional group(s).

So far, a variety of oils, ranging from mineral oils to those originated from animals and plants, have been used for such lubricants. Depending on the location where lubrication is required or on their required properties, a new lubricant that is suitable for these requirements is needed. As disclosed in patent document 8, polyethyleneglycol is known as a base of, for example, aqueous lubricant but there is still room for improvement in terms of lubricating functionality.

Furthermore, a low corrosive property is also required for the lubricants because the mechanical moving parts to which it is applied are typically metallic components.

PRIOR ART DOCUMENTS

Patent Documents

Patent document 1: JP-A-2014-131974
Patent document 2: JP-A-2014-131975
Patent document 3: JP-A-2015-48366
Patent document 4: JP-A-2015-124256
Patent document 5: JP-A-2016-117815
Patent document 6: JP-A-2016-155982

Patent document 7: JP-A-2016-155983
Patent document 8: JP-A-2006-83378

SUMMARY OF THE INVENTION

Problems to be Solved by the Invention

The present invention was made in view of the aforementioned circumstances, and the main object of the present invention is to provide an additive or composition for imparting lubricity which has high lubricity and low-corrosion properties, is excellent in low-temperature fluidity, thermal conductivity, thermal stability, and oxidative stability, and has a high flash point.

Means to Solve the Problems

In order to solve the aforementioned problem, the additive or composition of the present invention is characterized by a lubricity-imparting additive or composition to which the following components (A) and (B) have been added, wherein at least one of the components (A) and (B) contains a hydrogen-bonding functional group, where (A) is an amine or an ammonium compound; and (B) is an acid, or a salt thereof.

Effects of the Invention

According to the present invention, the additive or composition for imparting lubricity has high lubricity and low-corrosion properties, is excellent in low-temperature fluidity, thermal conductivity, thermal stability, and oxidative stability, and has a high flash point.

MODE FOR CARRYING OUT THE INVENTION

The present invention is described in detail hereunder.

The additive or composition for imparting lubricity according to the present invention is an additive or composition to which the aforementioned components (A) and (B) have been added, wherein at least one of the components (A) and (B) contains a hydrogen-bonding functional group.

Skeletons of the amine compounds in component (A) are not particularly limited, and examples of which include amines (ammonia, primary amine, secondary amine, tertiary amine), cyclic amines such as imidazole, pyridine, pyrrolidine, piperidine, pyrroline, pyrazine, triazine, isoquinoline, oxazoline, thiazoline, morpholine, guanidine, pyrimidine, piperazine, triazine, quinoline, indole, quinoxaline, and isoxazoline and various amino acids, among which preferred are amines, imidazole, pyridine, pyrrolidine, piperidine and morpholine, and amines are more preferred. Further, they may contain, for example, a substituent group as outlined in the section of [Substituent Group] to be described below.

Examples of the ammonium compound in component (A) include salts of the aforementioned amine compounds, or compounds obtained by quaternizing the aforementioned amine compounds.

It is preferred that component (A) have a hydrogen-bonding functional group(s). Although not particularly limited, examples of the hydrogen-bonding functional group contained in component (A) include an oxygen-containing group, a nitrogen-containing group, a sulfur-containing group, a phosphorus-containing group, and a hydrogen atom directly bonded to nitrogen.

Although not particularly limited, examples of the oxygen-containing group include a hydroxy group, carbonyl group, ether group, ester group, aldehyde group, carboxy group, carboxylate group, urea group, urethane group, amide group, oxazole group, morpholine group, carbamic acid group and carbamate group.

Although not particularly limited, examples of the nitrogen-containing group include an amino group and a nitro group.

Although not particularly limited, examples of the sulfur-containing group include a sulfate group (—O—S(=O)$_2$—O—), a sulfonyl group (—S(=O)$_2$O—), a sulfonate group (—S(=O)$_2$—), a mercapto group (—SH), a thioether group (—S—), a thiocarbonyl group (—C(=S)—), a thiourea group (—N—C(=S)—N—), a thiocarboxy group (—C(=S)OH), a thiocarboxylate group (—C(=S)O—), a dithiocarboxy group (—C(=S)SH) and a dithiocarboxylate group (—C(=S)S—).

Although not particularly limited, examples of the phosphorus-containing group include a phosphate group (—O—P(=O)(—O—)—O—), a phosphonic acid group (—P(=O)(—O—)—O—), a phosphinic acid group (—P(=O)—O—), a phosphite group (—O—P(—O—)—O—), a phosphonous acid group (—P(—O—)—O—), a phosphinous acid group (—P—O—) and a pyrophosphate group [(—O—P(=O)(—O—))$_2$—O—].

It is preferred in terms of affinity to water and affinity to metallic coordination that a hydrogen-bonding functional group contained in component (A) be a hydroxy group, a carboxy group, a carboxylate group, an ester group, an ether group, an alkoxy group, or a hydrogen atom directly bonded to nitrogen. Among them, more preferred are a hydroxy group, a carboxy group, a carboxylate group, an ether group, an alkoxy group, and a hydrogen atom directly bonded to nitrogen; even more preferred are a hydroxy group, a carboxy group, a carboxylate group, and a hydrogen atom directly bonded to nitrogen; particularly preferred are a hydroxy group, a carboxy group, and a hydrogen atom directly bonded to nitrogen; most preferred are a hydroxy group and a hydrogen atom directly bonded to nitrogen. A preferable example of a substituent group having such hydrogen-bonding functional group includes a hydrocarbon group having a hydrogen-bonding functional group. Examples of the substituent group having such hydrogen-bonding functional group include a hydrocarbon group containing a hydroxy group (hydroxy hydrocarbon group), a hydrocarbon group containing a carboxy group (carboxy hydrocarbon group), a hydrocarbon group containing a hydroxy group and a carboxy group (hydroxycarboxy hydrocarbon group), a hydrocarbon group including a carboxylate group, a hydrocarbon group including an ester group, a hydrocarbon group containing an ether group, and a hydrocarbon group containing an alkoxy group. Among them, preferred is a hydroxy hydrocarbon group.

Examples of such hydrocarbon groups include a saturated or unsaturated aliphatic hydrocarbon group, a saturated or unsaturated alicyclic hydrocarbon group, and an aromatic hydrocarbon group, as well as a hydrocarbon group of any combination thereof. These hydrocarbon groups may be those of conventional ones. Among these hydrocarbon groups, preferred is a saturated aliphatic hydrocarbon group. Examples of the hydrocarbon groups include those as listed in the section of "Hydrocarbon group" as hereinafter defined.

For example, although not particularly limited, the aforementioned hydroxy hydrocarbon group has at least one hydroxy group for the sake of lubricity, and the hydrocarbon moiety thereof is a linear or branched moiety having, preferably 1 to 22 carbon atoms, more preferably 1 to 18 carbon atoms, even more preferably 1 to 12 carbon atoms, particularly more preferably 1 to 6 carbon atoms; such hydrocarbon moiety may also contain an oxygen atom(s).

The aforementioned carboxy hydrocarbon group has at least one carboxy group, and the hydrocarbon moiety thereof is a linear or branched moiety having preferably 1 to 22 carbon atoms, more preferably 1 to 18 carbon atoms, even more preferably 1 to 12 carbon atoms, particularly more preferably 1 to 6 carbon atoms; such hydrocarbon moiety may also contain an oxygen atom(s).

The aforementioned hydroxycarboxy hydrocarbon group has at least one hydroxy group and at least one carboxy group, and the hydrocarbon moiety thereof is a linear or branched moiety having preferably 1 to 22 carbon atoms, more preferably 1 to 18 carbon atoms, even more preferably 1 to 12 carbon atoms, particularly more preferably 1 to 6 carbon atoms; such hydrocarbon moiety may also contain an oxygen atom(s).

The aforementioned carboxylate group-containing hydrocarbon group has at least one carboxylate group, and each hydrocarbon moiety thereof is a linear or branched moiety having preferably 1 to 22 carbon atoms, more preferably 1 to 18 carbon atoms, even more preferably 1 to 12 carbon atoms, particularly more preferably 1 to 6 carbon atoms; such hydrocarbon moiety may also contain an oxygen atom(s).

The aforementioned ester group-containing hydrocarbon group has at least one ester group, and each hydrocarbon moiety thereof is a linear or branched moiety having preferably 1 to 22 carbon atoms, more preferably 1 to 18 carbon atoms, even more preferably 1 to 12 carbon atoms, particularly more preferably 1 to 6 carbon atoms; such hydrocarbon moiety may also contain an oxygen atom(s).

The aforementioned ether group-containing hydrocarbon group has at least one ether group, and each hydrocarbon moiety thereof is a linear or branched moiety having preferably 1 to 22 carbon atoms, more preferably 1 to 18 carbon atoms, even more preferably 1 to 12 carbon atoms, particularly more preferably 1 to 6 carbon atoms; such hydrocarbon moiety may also contain an oxygen atom(s).

The aforementioned alkoxy group-containing hydrocarbon group has at least one alkoxy group, and each hydrocarbon moiety thereof is a linear or branched moiety having preferably 1 to 22 carbon atoms, more preferably 1 to 18 carbon atoms, even more preferably 1 to 12 carbon atoms, particularly more preferably 1 to 6 carbon atoms; such hydrocarbon moiety may also contain an oxygen atom(s).

Here, when the hydrocarbon moiety contains an oxygen atom(s), such oxygen atom(s), for example, either form or contain, in the hydrocarbon moiety, an ether bond, a carbonyl group, an ester bond, an amide bond, a urea bond or a urethane bond. Therefore, in this invention, the expression "the hydrocarbon moiety contains an oxygen atom(s)" encompasses a case where the hydrocarbon moiety is interrupted by, or the hydrogen atom(s) are substituted by a group serving as an oxygen atom-containing atom group that even may contain a hetero atom(s) such as a nitrogen atom or a case where the group is present therein at its base end.

Examples of the aforementioned hydroxyhydrocarbon group include a saturated or unsaturated aliphatic hydrocarbon group having at least one hydroxy group, a saturated or unsaturated alicyclic hydrocarbon group, and an aromatic hydrocarbon group, as well as a hydrocarbon group of any combination thereof, among which a saturated aliphatic hydrocarbon group having one hydroxy group (such as a monohydroxyalkyl group) and a saturated aliphatic hydrocarbon group having at least two hydroxy groups (such as a polyhydroxyalkyl group) are preferred. The hydroxyhydrocarbon group may contain the aforementioned oxygen-containing group(s).

Although not particularly limited, examples of the saturated aliphatic hydrocarbon group having one hydroxy group (monohydroxyalkyl group) include a hydroxymethyl group, 1-hydroxyethyl group, 2-hydroxyethyl group, 1-hydroxypropane-1-yl group, 2-hydroxypropane-1-yl group, 3-hydroxypropane-1-yl group, 1-hydroxypropane-2-yl group, 2-hydroxypropane-2-yl group, 2-hydroxymethylpropane-2-yl group, 2-hydroxyethylpropane-2-yl group, 1-hydroxybutane-1-yl group, 2-hydroxybutane-1-yl group, 3-hydroxybutane-1-yl group, 4-hydroxybutane-1-yl group, 1-hydroxy-2-methylpropane-1-yl group, 2-hydroxy-2-methylpropane-1-yl group, 3-hydroxy-2-methylpropane-1-yl group, 1-hydroxybutane-2-yl group, 2-hydroxybutane-2-yl group, 3-hydroxybutane-2-yl group, 4-hydroxybutane-2-yl group, 1-hydroxy-2-methylpropane-2-yl group, 5-hydroxypentane-1-yl group, 2-hydroxymethylpentane-2-yl group, 2-hydroxyethylpentane-2-yl group, 6-hydroxyhexane-1-yl group, 7-hydroxyheptane-1-yl group, 8-hydroxyoctane-1-yl group, 9-hydroxynonane-1-yl group, 10-hydroxydecane-1-yl group. 2-methy-1-hydroxypropane-2-yl group, 2-methy-1-propane-2-yl group, 1-hydroxy-2-methypropane-2-yl group, 1-hydroxy-3-methybutane-2-yl group, 2-hydroxy-2-methypropane-2-yl group, 2-hydroxy-2-methybutane-2-yl group, 2-ethyl-2-hydroxybutane-2-yl group, 2-hydroxy-3-methypentane-2-yl group, 3-ethyl-2-hydroxypentane-2-yl group, 2-ethyl-1-hydroxy-3-methybutane-2-yl group, 1-hydroxy-3-methy-2-(1-methyethyl)butane-2-yl group, 2-ethyl-1-hydroxypentane-2-yl group, 1-hydroxy-2-propylpentan-2-yl group, 4-ethyl-3-hydroxyhexane-4-yl group, 3-ethyl-2-hydroxy-2-methypentane-3-yl group, 2-ethyl-1-hydroxyhexane-2-yl group, 1-hydroxy-2-propylhexane-2-yl group, 2-ethyl-1-hydroxyheptane-2-yl group, 2-ethyl-1-hydroxy-4-methypentane-2-yl group, 1-hydroxy-2-(1-methyethyl)pentane-2-yl group, and 3-ethyl-4-hydroxyheptane-3-yl group. It is preferred for the monohydroxyalkyl group to have 1 to 22 carbon atoms, more preferably 1 to 18 carbon atoms, even more preferably 1 to 12 carbon atoms, particularly preferably 1 to 6 carbon atoms for the sake of lubricity.

Although not particularly limited, examples of the saturated aliphatic hydrocarbon group having at least two hydroxy groups (such as a polyhydroxyalkyl group) include a di-, tri-, tetra-, penta-, hexa-, hepta- or octahydroxyalkyl group.

Although not particularly limited, specific examples thereof include dihydroxyethyl groups such as 1,2-dihydroxyethyl group; dihydroxypropane-1-yl groups such as 1,2-dihydroxypropane-1-yl group and 2,3-dihydroxypropane-1-yl group; dihydroxypropane-2-yl groups such as 1,2-dihydroxypropane-2-yl group and 1,3-dihydroxypropane-2-yl group; trihydroxypropane-1-yl group; trihydroxypropane-2-yl group; dihydroxybutane-1-yl groups such as 1,2-dihydroxybutane-1-yl group, 1,3-dihydroxybutane-1-yl group, 1,4-dihydroxybutane-1-yl group, 2,3-dihydroxybutane-1-yl group, 2,4-dihydroxybutane-1-yl group and 3,4-dihydroxybutane-1-yl group; trihydroxybutane-1-yl groups such as 1,2,3 trihydroxybutane-1-yl group, 1,2,4 trihydroxybutane-1-yl group, 1,3,4 trihydroxybutane-1-yl group and 2,3,4 trihydroxybutane-1-yl group; tetrahydroxybutane-1-yl group; dihydroxy-2-methylpropane-1-yl groups such as 1,2-dihydroxy-2-methylpropane-1-yl group, 1,3-dihydroxy-2-methylpropane-1-yl group and 2,3-dihydroxy-2-methylpropane-1-yl group; trihydroxy-2-methylpropane-1-yl group; tetrahydroxy-2-methylpropane-1-yl group; dihydroxybutane-2-yl groups such as 1,2-dihydroxybutane-2-yl group, 1,3-dihydroxybutane-2-yl group, 1,4-dihydroxybutane-2-yl group, 2,3-dihydroxybutane-2-yl group, 2,4-dihydroxybutane-2-yl group and 3,4-dihydroxybutane-2-yl group; tetrahydroxybutane-2-yl group; 1,3-dihydroxy-2-methylpropane-2-yl group, 1,3-dihydroxy-2-ethylpropane-2-yl group, 1,3-dihydroxy-2-hydroxymethylpropane-2-yl group; 1,2-dihydroxypropane-3-yl group, 1,1-dihydroxybutane-2-yl group, 1,1-dihydroxypentane-2-yl group, 1,1-dihydroxy-5-methylhexane-2-yl group, 1,1-dihydroxypropane-2-yl group, and 1,1-dihydroxy-4-(-4-hydroxyphenyl) butane-2-yl group; di-, tri-, tetra- or pentahydroxypentane-1-yl group; di-, tri-, tetra-, penta- or hexahydroxyhexane-1-yl group; di-, tri-, tetra-, penta-, hexa- or heptahydroxyheptane-1-yl group; and di-, tri-, tetra-, penta-, hexa-, hepta- or octahydroxyoctane-1-yl group. It is preferred in terms of lubricity that the polyhydroxyalkyl group have 2 to 8, more preferably 2 to 6 hydroxy groups. It is preferred that the alkyl moiety of such polyhydroxyalkyl group have 1 to 22 carbon atoms, more preferably 1 to 18 carbon atoms, even more preferably 1 to 12 carbon atoms, particularly preferably 1 to 6 carbon atoms. Further, one preferable example is a branched polyhydroxyalkyl group represented by the following formula.

[Chemical Formula 1]

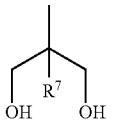

In this formula, $R^7$ represents a hydrogen atom, a linear alkyl group having 1 to 8 carbon atoms (preferably 1 to 4 carbon atoms), or a linear hydroxyalkyl group having 1 to 8 carbon atoms (preferably 1 to 4 carbon atoms).

Examples of the groups set by the aforementioned formula include, but are not limited to, 1,2-dihydroxypropane-1-yl group, 2,3-dihydroxypropane-1-yl group, 1,2-dihydroxypropane-2-yl group, 1,3-dihydroxypropane-2-yl group, trihydroxypropane-1-yl group, trihydroxypropane-2-yl group, trihydroxypropane-1-yl group, trihydroxypropane-2-yl group, 1,2-dihydroxybutane-1-yl group, 1,3-dihydroxybutane-1-yl group, 1,4-dihydroxybutane-1-yl group, 2,3-dihydroxybutane-1-yl group, 2,4-dihydroxybutane-1-yl group, 3,4-dihydroxybutane-1-yl group, 1,2,3-trihydroxybutane-1-yl group, 1,2,4-trihydroxybutane-1-yl group 1,3,4-trihydroxybutane-1-yl group, 2,3,4-trihydroxybutane-1-yl group, tetrahydroxybutane-1-yl group, 1,2-dihydroxy-2-methylpropane-1-yl group, 1,3-dihydroxy-2-methylpropane-1-yl group, 2,3-dihydroxy-2-methylpropane-1-yl group, trihydroxy-2-methylpropane-1-yl group, tetrahydroxy-2-methylpropane-1-yl group, 1,2-dihydroxybutane-2-yl group, 1,3-dihydroxybutane-2-yl group, 1,4-dihydroxybutane-2-yl group, 2,3-dihydroxybutane-2-yl group, 2,4-dihydroxybutane-2-yl group, 3,4-dihydroxybutane-2-yl group, tetrahydroxybutane-2-yl group, 1,3-dihydroxy-2-methylpropane-2-yl group, 1,3-dihydroxy-2-ethylpropane-2-yl group, 1,3-dihydroxy-2-hydroxymethylpropane-2-yl group, tetrahydroxybutane-2-yl group, 1,3-dihydroxy-2-methylpropane-2-yl group, 1,3-dihydroxy-2-ethylpropane-2-yl group, 1,3-dihydroxy-2-hydroxymethylpropane-2-yl group, 1,2-dihydroxypropane-3-yl group, 1,1-dihydroxybutane-2-yl group, 1,1-dihydroxypentane-2-yl group, 1,1-dihydroxy-5-methylhexane-2-yl group, 1,1-dihydroxypropane-2-yl group, 1,1-dihydroxy-4-(-4-hydroxyphenyl)

butane-2-yl group, di-, tri-, tetra- or pentahydroxypentane-1-yl group; di-, tri-, tetra-, penta- or hexahydroxyhexane-1-yl group; di-, tri-, tetra-, penta-, hexa- or heptahydroxyheptane-1-yl group; and di-, tri-, tetra-, penta-, hexa-, hepta- or octahydroxyoctane-1-yl group.

Among the above polyhydroxyalkyl groups, preferred are 2,3-dihydroxypropane-1-yl group, 1,3-dihydroxypropane-2-yl group, 1,3-dihydroxy-2-ethylpropane-2-yl group, 1,3-dihydroxy-2-hydroxymethylpropane-2-yl group and pentahydroxyhexane-1-yl group.

Examples of the aforementioned carboxy hydrocarbon group include a saturated or unsaturated aliphatic hydrocarbon group having at least one carboxy group, a saturated or unsaturated alicyclic hydrocarbon group, and an aromatic hydrocarbon group, as well as a hydrocarbon group of any combination thereof, among which a monocarboxyalkyl group and a polycarboxyalkyl group whose hydrocarbon group is a saturated aliphatic hydrocarbon group (such as an alkyl group) are preferred. Specific examples thereof include groups having an equivalent structure with those obtained by substituting the hydroxy groups in any of the mono-, di-, tri-, tetra-, penta-, hexa-, hepta- or octahydroxyalkyl groups exemplified above with a carboxy group(s) (alkyl moieties of such groups may contain oxygen atoms).

It is preferred that the monocarboxyalkyl group and polycarboxyalkyl group have 1 to 22 carbon atoms, more preferably 1 to 18 carbon atoms, even more preferably 1 to 12 carbon atoms, particularly preferably 1 to 6 carbon atoms.

Examples of the aforementioned hydroxycarboxy hydrocarbon group include a saturated or unsaturated aliphatic hydrocarbon group having at least one hydroxy group and at least one carboxy group, a saturated or unsaturated alicyclic hydrocarbon group, and an aromatic hydrocarbon group, as well as a hydrocarbon group of any combination thereof, among which those having a saturated aliphatic hydrocarbon group (alkyl group) as a hydrocarbon group is preferred. Examples thereof include, but are not particularly limited to, groups having a structure established by substituting part of the hydroxy groups in any of the mono-, di-, tri-, tetra-, penta-, hexa-, hepta- or octahydroxyalkyl groups exemplified above with a carboxy group(s) (alkyl moieties of such groups may contain oxygen atoms). It is preferred that the hydroxycarboxy alkyl group have 1 to 22 carbon atoms, more preferably 1 to 18 carbon atoms, even more preferably 1 to 12 carbon atoms, particularly preferably 1 to 6 carbon atoms.

Examples of the aforementioned ester group-containing hydrocarbon group include a saturated or unsaturated aliphatic hydrocarbon group having at least one ester group, a saturated or unsaturated alicyclic hydrocarbon group, an aromatic hydrocarbon group, as well as a hydrocarbon group of any combination thereof, among which those having a hydrocarbon group of a saturated aliphatic hydrocarbon group (alkyl group) is preferred. Although not particularly limited, examples thereof include groups having an equivalent structure with those obtained by esterifying the carboxy groups in the carboxyalkyl groups exemplified above. It is preferred that the ester group-containing hydrocarbon group has 1 to 22 carbon atoms.

Examples of the aforementioned ether group-containing hydrocarbon group include a saturated or unsaturated aliphatic hydrocarbon group having at least one ester group, a saturated or unsaturated alicyclic hydrocarbon group, and an aromatic hydrocarbon group, as well as a hydrocarbon group of any combination thereof, among which those having a hydrocarbon group of a saturated aliphatic hydrocarbon group (alkyl group) are preferred.

Although not particularly limited, examples thereof include groups having an equivalent structure in which an alkyl group having 2 to 22 carbon atoms is interrupted by oxygen atom(s).

Examples of the aforementioned alkoxy group-containing hydrocarbon group include a saturated or unsaturated aliphatic hydrocarbon group having at least one ester group, a saturated or unsaturated alicyclic hydrocarbon group, and an aromatic hydrocarbon group, as well as a hydrocarbon group of any combination thereof, among which those having a hydrocarbon group of a saturated aliphatic hydrocarbon group (alkyl group) are preferred. Although not particularly limited, examples thereof include groups having an equivalent structure in which an end of the alkyl group having a total carbon number of 1 to 22 is bonded to an alkyl ether group or an equivalent structure in which a hydrogen atom(s) of the hydrocarbon group is/are substituted by an alkyl ether group.

Examples of the aforementioned carboxylate group-containing hydrocarbon group include a saturated or unsaturated aliphatic hydrocarbon group having at least one ester group, a saturated or unsaturated alicyclic hydrocarbon group, an aromatic hydrocarbon group, as well as a hydrocarbon group of any combination thereof, among which those having a hydrocarbon group of a saturated aliphatic hydrocarbon group (such as an alkyl group) are preferred. Although not particularly limited, examples thereof include groups having an equivalent structure in which an end of the alkyl group having a total carbon number of 1 to 22 is bonded to a carboxylate group or an equivalent structure in which a hydrogen atom(s) of the hydrocarbon group is/are substituted by a carboxylate group.

Examples of a substituent group, other than the hydrogen-bonding functional group(s), in component (A) and a cation originated from component (A) include an organic group.

[Organic Group]

The term "organic group" as used herein refers to a group that essentially contains carbon atom(s) and optionally contains at least one further species selected from hydrogen atom, oxygen atom, nitrogen atom, sulfur atom, phosphorus atom, and halogen atom. Examples of atom group(s) contained in the organic group include, but are not limited to, a hydrocarbon group, a heterocyclic group, and a substituent group as set forth in the section of "substituent group" to be hereinafter described. Examples of such also include a group in which the substituent group, as set forth in the section of "substituent group" to be hereinafter described, or other group substitutes a hydrogen atom (s) in a hydrocarbon group, interrupts a hydrocarbon group, and/or is present at a base end(s) of a hydrocarbon group, as well as a group in which the substituent group, as set forth in the section of "substituent group" to be hereinafter described, or other group forms a condensed ring with an aromatic hydrocarbon group. It is preferred in terms of, for example, lubricity that the number of carbon atoms in the organic group be 1 to 22. In terms of affinity for water or for the surfaces of various materials such as metals, foam suppression and washability, it is preferred that the number of the carbon atoms be 1 to 22, more preferably 1 to 18, even more preferably 1 to 12, particularly preferably 1 to 8, and most preferably 1 to 4.

[Hydrocarbon Group]

Examples of the hydrocarbon group as used herein include, but are not limited to, a saturated or unsaturated aliphatic hydrocarbon group, a saturated or unsaturated alicyclic hydrocarbon group, an aromatic hydrocarbon group and a hydrocarbon group of any combination thereof. The group may be monovalent or multivalent depending on the context of the application, and examples of a saturated or unsaturated monovalent aliphatic hydrocarbon group include, but are not limited to, a linear or branched alkyl group, alkenyl group, and alkynyl group. Examples of the alkyl group include linear or branched ones, and include, but are not particularly limited to, a methyl group, ethane-1-yl group, propane-1-yl group, 1-methyl ethane-1-yl group, butane-1-yl group, butane-2-yl group, 2-methyl propane-1-yl group, 2-methyl propane-2-yl group, pentane-1-yl group, pentane-2-yl group, hexane-1-yl group, heptane-1-yl group, octane-1-yl group, 2-ethyl hexane-1-yl group, 1,1,3,3-tetramethyl butane-1-yl group, nonane-1-yl group, decane-1-yl group, undecane-1-yl group, dodecane-1-yl group, tridecane-1-yl group, tetradecane-1-yl group, pentadecane-1-yl group, hexadecane-1-yl group, 2-hexyl decane-1-yl group, heptadecane-1-yl group, octadecane-1-yl group, nonadecane-1-yl group, icosane-1-yl group, henicosane-1-yl group, docosane-1-yl group, 4,8,12-trimethyl tridecane-1-yl group, benzyl group, and α,α-dimethyl benzyl group. Examples of the alkenyl group include linear or branched ones, and include, but are not particularly limited to, a vinyl group, prop-1-en-1-yl group, allyl group, isopropenyl group, but-1-en-1-yl group, but-2-en-1-yl group, but-3-en-1-yl group, 2-methylprop-2-en-1-yl group, 1-methylprop-2-en-1-yl group, pent-1-en-1-yl group, pent-2-en-1-yl group, pent-3-en-1-yl group, hent-4-en-1-yl group, 3-methylbut-2-en-1-yl group, 3-methylbut-3-en-1-yl group, hex-1-en-1-yl group, hex-2-en-1-yl group, hex-3-en-1-yl group, hex-4-en-1-yl group, hex-5-en-1-yl group, 4-methylpent-3-en-1-yl group, hept-1-en-1-yl group, hept-6-en-1-yl group, oct-1-en-1-yl group, oct-7-en-1-yl group, non-1-en-1-yl group, non-8 1-yl group, dec-1-en-1-yl group, dec-9-en-1-yl group, undec-1-en-1-yl group, undec-10-en-1-yl group, dodec-1-en-1-yl group, dodec-11-en-1-yl group, tridec-1-en-1-yl group, tridec-12-en-1-yl group, tetradec-1-en-1-yl group, tetradec-13-en-1-yl group, pentadec-1-en-1-yl group, pentadec-14-en-1-yl group, hexadec-1-en-1-yl group, hexadec-15-en-1-yl group, heptadec-1-en-1-yl group, heptadec-16-en-1-yl group, octadec-1-en-1-yl group, octadec-9-en-1-yl group, octadec-17-en-1-yl group, nonadec-1-en-1-yl group, icos-1-en-1-yl group, henicos-1-en-1-yl group, and a docos-1-en-1-yl group. Examples of the alkynyl group include linear or branched ones, and include, but are not particularly limited to, an ethynyl, prop-1-yn-1-yl group, prop-2-yn-1-yl group, but-1-yn-1-yl group, but-3-yn-1-yl group, 1-methylprop-2-yn-1-yl group, pent-1-yn-1-yl group, pent-4-yn-1-yl group, hex-1-yn-1-yl group, hex-5-yn-1-yl group, hept-1-yn-1-yl group, hept-6-yn-1-yl group, oct-1-yn-1-yl group, oct-7-yn-1-yl group, non-1-yn-1-yl group, non-8-yn-1-yl group, dec-1-yn-1-yl group, dec-9-yn-1-yl group, undec-1-yn-1-yl group, undec-10-yn-1-yl group, dodec-1-yn-1-yl group, dodec-11-yn-1-yl group, tridec-1-yn-1-yl group, tridec-12-yn-1-yl group, tetradec-1-yn-1-yl group, tetradec-13-yn-1-yl group, pentadec-1-yn-1-yl group, pentadec-14-yn-1-yl group, hexadec-1-yn-1-yl group, hexadec-15-yn-1-yl group, heptadec-1-yn-1-yl group, heptadec-16-yn-1-yl group, octadec-1-yn-1-yl group, octadec-17-yn-1-yl group, nonadec-1-yn-1-yl group, icos-1-yn-1-yl group, henicos-1-yn-1-yl group, and a docos-1-yn-1-yl group.

The saturated or unsaturated alicyclic hydrocarbon group is preferably a saturated alicyclic hydrocarbon group, and examples of which include, but are not particularly limited to, a cyclopropyl group, cyclobutyl group, cyclopentyl group, cyclohexyl group, cycloheptyl group and a cyclooctyl group as monovalent groups, as well as groups containing alicyclic residues of those or other residues, Examples of the aromatic hydrocarbon group include, but are not particularly limited to, a phenyl group, naphthalene group, an anthracene group, as well as groups containing aromatic ring residues of those or other residues. The group may form a condensed ring together with the groups as set forth in [Substituent Group] to be described below. Examples of the monovalent aromatic hydrocarbon group include, but are not particularly limited to, a phenyl group, 2-methylphenyl group, 3-methylphenyl group, 4-methylphenyl group, 2,4-dimethylphenyl group, 2,5-dimethylphenyl group, 3,4-dimethylphenyl group, 3,5-dimethylphenyl group, 2,4,5-trimethylphenyl group, 2,4,6-trimethylphenyl group, 4-ethylphenyl group, 4-propylphenyl group, 4-isopropylphenyl group, 4-butylphenyl group, 4-tert-butylphenyl group, 4-pentylphenyl group, 4-tert-pentylphenyl group, 2,4-bis(4-tert-pentyl) phenyl group, 1,1,3,3-tetramethylbutylphenyl group, 2-methyl-5-tert-butylphenyl group, 4-pentylphenyl group, 4-hexylphenyl group, 4-heptylphenyl group, 4-octylphenyl group, 4-nonylphenyl group, 4-decanylphenyl group, 4-undecylphenyl group, 4-dodecylphenyl group, 4-tridecylphenyl group, 4-tetradecylphenyl group, 4-pentadecylphenyl group, 4-hexadecylphenyl group, 4-heptadecylphenyl group, 4-octadecylphenyl group, 4-biphenyl group, 2-methoxyphenyl group, 3-methoxyphenyl group, 4-methoxyphenyl group, 2-ethoxyphenyl group, 3-ethoxyphenyl group, 4-ethoxyphenyl group, 2-chlorophenyl group, 2-fluorophenyl group, 4-fluorophenyl group, 2-trifluoromethylphenyl group, 4-trifluoromethylphenyl group, 4-hydroxyphenyl group, 1-naphthyl group, 2-naphthyl group, 1-anthracenyl group, 2-anthracenyl group and 9-anthracenyl group.

Examples of the bivalent aromatic group include groups having a structure established by subtracting one hydrogen atom from the aforementioned groups.

[Substituent Group]

Examples of the above-mentioned substituent group include, but are particularly limited to, a hydrocarbon group, an oxygen-containing group, a nitrogen-containing group, a sulfur-containing group, a phosphorus-containing group, and a halogen. The substituent group also includes a group to which these substituent groups are connected.

Examples of the above-mentioned hydrocarbon group include those listed in [Substituent Group] as mentioned above.

Although not particularly limited, examples of the oxygen-containing group include a hydroxy group, an alkoxy group, an acetoxy group, an acetyl group, an aldehyde group, a carboxy group, a carboxylate group, a urea group, a urethane group, an amide group, an imide group, an ether group, a carbonyl group, an ester group, an oxazole group, a morpholin group, a carbamate group, a carbamoyl group, a polyoxyethylene group, a tocopheryl group, a chroman group, a dihydropyran group, a glyceryl group, and a glyceryl ether group.

Examples of the nitrogen-containing group include, but are not particularly limited to, a cyano group, a cyanato group, an isocyanate group, a nitro group, a nitroalkyl group, an amide group, a urea group, a urethane group, an imide group, a carbodiimide group, an azo group, a pyridine group, an imidazole group, a primary amino group, a secondary amino group, a tertiary amino group, a quaternary ammonium group, and an aminoalkyl group.

Examples of the sulfur-containing group include, but are not particularly limited to, a sulfate group, a sulfonyl group, a sulfonate group, a mercapto group, a thioether group, a thiocarbonyl group, a thiourea group, a thiocarboxy group, a thiocarboxylate group, a dithiocarboxy group, a dithiocarboxylate group, a sulfuric ester, a thiophene group, a thiazole group, a thiol group, a sulfo group, a sulfide group, a disulfide group, a thioester group, a thioamide group, a thiocarbamate group, and a dithiocarbamate group, and esters thereof.

Examples of the phosphorus-containing group include, but are not particularly limited to, a phosphate group, a phosphorous acid group, a phosphonic acid group, a phosphinic acid group, a phosphonous acid group, a phosphinous acid group, a pyrophosphate group, a phosphate group, a phosphorous acid ester group, a phosphonic acid ester group, a pyrophosphate group and esters thereof.

Examples of the halogen include fluorine, chlorine, bromine, and iodine.

Examples of the organic group include a hydrocarbon group that may contain a substituent group, wherein the hydrocarbon moiety thereof may also contain an oxygen atom(s). Examples of the above-mentioned hydrocarbon group include the contents as referred to and set forth in the section of [Substituent Group]. The hydrocarbon group is preferably an aliphatic hydrocarbon group, among which a saturated aliphatic hydrocarbon group (such as an alkyl group) is more preferred. It is preferred in terms of, for example, lubricity that such alkyl group be a linear or branched group having 1 to 22 carbon atoms, more preferably a linear or branched group having 4 to 22 carbon atoms, even more preferably a linear or branched group having 8 to 22 carbon atoms, particularly preferably a linear or branched group having 12 to 22 carbon atoms. Meanwhile, it is preferred in terms of, for example, affinity with water or to surfaces of various materials such as metals, foam suppression and washability that such alkyl group be a linear or branched group having 1 to 22 carbon atoms, more preferably a linear or branched group having 1 to 18 carbon atoms, even more preferably a linear or branched group having 1 to 12 carbon atoms, particularly preferably a linear or branched group having 1 to 8 carbon atoms and most preferably a linear or branched group having 1 to 4 carbon atoms.

The aforementioned hydrocarbon groups may contain a substituent group(s), and examples of such substituent groups include, but are not particularly limited to, those listed in the [Substituent Group] as mentioned above. Among the substituent groups, preferred are those having an oxygen-containing group, among which a hydroxy group, a carboxy group, a carboxylate group, an ester group, an ether group and an alkoxy group are preferred. Among them, more preferred are a hydroxy group, a carboxy group, a carboxylate group, an ether group and an alkoxy group; even more preferred are a hydroxy group, a carboxy group and a carboxylate group; and particularly preferred are a hydroxy group and a carboxy group.

The aforementioned hydrocarbon moiety may contain an oxygen atom(s), and in which case such hydrocarbon moiety contains the aforementioned oxygen-containing group, and forms or contains an ether bond, a carbonyl group, a hydroxy group, a carboxylate group, an ester bond, an amide bond, a urea bond or a urethane bond. Therefore, in this invention, the wording "hydrocarbon moiety contains an oxygen atom (s)" as used herein encompasses a case where the hydrocarbon moiety is interrupted by, or the hydrogen atom(s) thereof are substituted by a group serving as an oxygen atom-containing atom group that even may contain optionally a hetero atom(s) such as a nitrogen atom, or a case where the group is contained therein is present at its base end.

It is one of the preferable embodiments for the component (A) to have a hydrocarbon group (more preferably a saturated aliphatic hydrocarbon group) containing at least one hydrogen-bonding functional group in terms of having advantages of the present invention i.e. high lubricity and low-corrosion properties, in addition to affinity for surfaces of various materials such as metals, and affinity for water in a case where the component (A) is used as an aqueous lubricant composition.

In this case, it is preferred that at least one moiety in component (A) into which a functional group can be introduced (atoms contained in chemical structures as basic skeletons, such as a nitrogen moiety, and a carbon moiety composing a ring together with nitrogen) be substituted by a hydrogen-bonding functional group-containing hydrocarbon group(s), and the rest of those moieties independently be hydrogen atoms, or substituted by an organic group(s) such as a hydrocarbon group(s) (more preferably a saturated aliphatic hydrocarbon group).

Further, it is more preferred that the component (A) be an amine composed only of a hydrocarbon group (more preferably a saturated aliphatic hydrocarbon group) having a hydrogen-bonding functional group, or be an amine composed only of hydrogen atom(s) directly bonded to nitrogen and a hydrocarbon group (more preferably a saturated aliphatic hydrocarbon group) having a hydrogen-bonding functional group, and an amine composed only of hydrogens. It is even more preferred that the component (A) be an amine composed only of a hydrocarbon group (more preferably a saturated aliphatic hydrocarbon group) having a hydrogen-bonding functional group, or an amine composed only of hydrogen atom(s) directly bonded to nitrogen and a hydrocarbon group (more preferably a saturated aliphatic hydrocarbon group) having a hydrogen-bonding functional group. It is still more preferred that the component (A) be an amine composed only of a hydrocarbon group (more preferably a saturated aliphatic hydrocarbon group) having a hydrogen-bonding functional group. The aforementioned hydrogen-bonding functional group is preferably a hydroxy group. It is also a preferable embodiment for the component (A) that a moiety in component (A) into which a functional group can be introduced is composed only of hydrocarbon group(s) (more preferably a saturated aliphatic hydrocarbon group)

In terms of safety, it is preferred that the component (A), if it has a monohydroxyalkyl group, be a triethanolamine or diethanolamine, among which triethanolamine is particularly preferred. As for the diethanolamine, the amino group thereof is known to be changed into nitrosamines that are partially cancer-causing as a result of, for example, heat applications or with the passage of time. Accordingly, in terms of safety, triethanolamine is preferred over diethanolamine.

Further, in terms of safety and usage, it is preferred that the component (A) employ, as a raw material(s) (e.g. acids, bases), compounds listed in Japanese standards of quasi-drug ingredients (JSQI), Japanese standards of quasi-drug additives, Japanese pharmacopoeia (JP), Japanese pharmaceutical codex (JPC), Japanese pharmaceutical excipients (JPE) and Japan's specifications and standards for food additives (JSFA), and preferable examples of which include, but are not particularly limited to, a monoethanolamine, diethanolamine, triethanolamine, 2-amino-2-hydroxymethyl-1,3-propanediol, 2-amino-2-methyl-1-propanol, 2-amino-2-methyl-1,3-propanediol, monoisopropanolamine, diisopropanolamine, triisopropanolamine, 2-acetylaminoethanolamine, N-lauryldiethanolamine, dimethyloctadecylamine; in terms of low odor, more preferred are a 2-amino-2-hydroxymethyl-1,3-propanediol and 2-amino-2-methyl-1,3-propanediol.

In terms of safety and usage, as for the cation originated from component (A), preferred is a cation where a cationic residue such as hydrogen atom is bonded to the aforementioned amine compound, and the cationic residue such as hydrogen atom may be originated from component (B).

The residues in component (B) as used herein refer to atoms or atomic groups without a charge, and those having a charge and of cations are referred to as cationic residues while those of anions are referred to as anionic residues.

When component (A) is an ammonium compound, examples of the anions include, but are not particularly limited to, a hydroxide anion, a halogen-based anion, a sulfur-based anion, a phosphorus-based anion, a cyano-based anion, boron-based anion, a fluorine-based anion, a nitrogen oxide-based anion and a carboxylic acid anion, among which preferred is a hydroxide anion.

When the ammonium compound or amine of component (A) is an amine compound, the aforementioned component (A) is preferably be an amine compound of the following formula (I).

[Chemical formula 2]

$$N[R^1]_m[R^2]_{3-m} \quad (I)$$

In the formula, each $R^1$ independently represents a hydroxy hydrocarbon group in which there is at least one hydroxy group, wherein a hydrocarbon moiety thereof is a linear or branched moiety having 1 to 22 carbon atoms, and the hydrocarbon moiety optionally contains an oxygen atom (s); a carboxy hydrocarbon group in which there is at least one carboxy group, wherein a hydrocarbon moiety thereof is a linear or branched moiety having 1 to 22 carbon atoms, and the hydrocarbon moiety optionally contains an oxygen atom (s); or a hydroxycarboxy hydrocarbon group in which there are at least one hydroxy group and at least one carboxy group, wherein a hydrocarbon moiety thereof is a linear or branched moiety having 1 to 22 carbon atoms, and the hydrocarbon moiety optionally contains an oxygen atom(s); and in which each $R^2$ independently represents a hydrogen atom or a linear or branched organic group having 1 to 22 carbon atoms, and m represents an integer of 0 to 3.

It is preferred that m in the formula (I) represent an integer of 1 to 3.

It is preferred that all of the $R^2$ in the formula (I) be hydrogen atoms.

It is preferred that $R^1$ in the formula (I) be a hydroxy hydrocarbon group.

In the formula (1), as for a hydroxy hydrocarbon group, a carboxy hydrocarbon group and a hydroxycarboxy hydrocarbon group, it is preferred that a hydrocarbon in the hydrocarbon moiety optionally containing an oxygen atom (s) be a saturated aliphatic hydrocarbon.

It is preferred that at least one of the $R^1$s in the formula (I) have one hydroxy group, and a hydrocarbon of the hydrocarbon moiety is a hydroxy hydrocarbon group of a saturated aliphatic hydrocarbon.

It is preferred that at least one of the $R^1$s in the formula (I) have at least two hydroxy groups, and a hydrocarbon in the hydrocarbon moiety is a hydroxy hydrocarbon group of a saturated aliphatic hydrocarbon.

As for the respective preferable examples as shown in the formula (I), at least one of these combinations may be a more preferred embodiment(s).

When the amine or ammonium compound of component (A) is an ammonium compound, it is preferred that component (A) be an ammonium compound as expressed by the following formula (II).

[Chemical formula 3]

$$N^+[R^3]_n[R^4]_{4-n}X^- \quad (II)$$

In the formula, each $R^3$ independently represents a hydroxy hydrocarbon group in which there is at least one hydroxy group, wherein a hydrocarbon moiety thereof is a linear or branched moiety having 1 to 22 carbon atoms, and the alkyl hydrocarbon optionally contains an oxygen atom (s); a carboxy hydrocarbon group in which there is at least one carboxy group, wherein a hydrocarbon moiety thereof is a linear or branched moiety having 1 to 22 carbon atoms, and the hydrocarbon moiety optionally contains an oxygen atom (s); or a hydroxycarboxy hydrocarbon group in which there are at least one hydroxy group and at least one carboxy group, wherein a hydrocarbon moiety thereof is a linear or branched moiety having 1 to 22 carbon atoms, and the hydrocarbon moiety optionally contains an oxygen atom(s); and each $R^4$ independently represents a hydrogen atom or a linear or branched alkyl group having 1 to 22 carbon atoms, and n represents an integer of 0 to 4. $X^-$ represents an anion.

It is preferred that the anion expressed as $X^-$ in the formula (II) be a hydroxide ion.

It is preferred that n in the formula (II) represents an integer of 1 to 4.

It is preferred that all of the $R^4$s in the formula (II) be hydrogen atoms.

It is preferred that $R^3$ in the formula (II) be a hydroxy hydrocarbon group.

In the formula (II), as for a hydroxy hydrocarbon group, a carboxy hydrocarbon group, and a hydroxycarboxy hydrocarbon group, it is preferred that a hydrocarbon in the hydrocarbon moiety, optionally containing an oxygen atom (s) be a saturated aliphatic hydrocarbon.

It is preferred that at least one of the $R^3$s in the formula (II) have one hydroxy group, and a hydrocarbon in the hydrocarbon moiety is a hydroxy hydrocarbon group of a saturated aliphatic hydrocarbon.

It is preferred that at least one of the $R^3$s in the formula (I) have at least two hydroxy groups, and a hydrocarbon in the hydrocarbon moiety is a hydroxy hydrocarbon group of a saturated aliphatic hydrocarbon.

As for the respective preferable examples as shown in the formula (II), at least one of the combinations thereof may be a more preferred embodiment(s).

In the case of the additive or composition for imparting lubricity according to the present invention, an organic salt formed by the components (A) and (B) is also a preferable embodiment thereof.

It is preferred that it contains an organic salt formed by a cation originated from the component (A); and an anion originated from anionic residues of the component (B), wherein the cation originated from the component (A) optionally contains a cationic residue of the component (B).

The aforementioned cation is preferably an ammonium cation.

In the present invention, the organic ammonium salt contains an organic cation or $NH_4^+$ with a nitrogen atom being an ion center, and an organic anion. It particularly contains an organic cation and an organic anion. The term "organic" as used herein refers to those that contain a carbon(s) and a hydrogen(s) as elements.

Examples of a cation originated from the component (A) include, but are not limited to, an ammonium cation ($NR_4^+$, a primary ammonium cation, a secondary ammonium cation, a tertiary ammonium cation), amines originated from cyclic amines such as an imidazolium cation, pyridinium cation, pyrrolidinium cation, piperidinium cation, pyrrolinium cation, pyrazinium cation, triazolium cation, isoquinolinium cation, oxazolinium cation, thiazolinium cation, morpholinium cation, guanidium cation, pyrimidinium cation, piperazinium cation, triadinium cation, quinolinium cation, indolinium cation, quinoxalinium cation, isooxazolium cation, and cationic amino acids. Among them, preferred are an ammonium cation, imidazolium cation, pyridinium cation, pyrrolidinium cation, piperidinium cation and morpholinium cation; more preferred is an ammonium cation.

A cation of an ammonium salt formed by the components (A) and (B) is preferably a cation expressed by the following formula (III). In a case where the component (A) is an ammonium compound, the cation thereof is also preferably a cation expressed by the following formula (III).

[Chemical formula 4]

$$N^+[R^5]_o[R^8]_{4-o} \quad \text{(III)}$$

In the formula, each $R^5$ independently represents a hydroxy hydrocarbon group in which there is at least one hydroxy group, wherein a hydrocarbon moiety thereof is a linear or branched moiety having 1 to 22 carbon atoms, and the hydrocarbon moiety optionally contains an oxygen atom (s); a carboxy hydrocarbon group in which there is at least one carboxy group, wherein a hydrocarbon moiety thereof is a linear or branched moiety having 1 to 22 carbon atoms, and the hydrocarbon moiety optionally contain an oxygen atom (s); or a hydroxycarboxy hydrocarbon group in which there are at least one hydroxy group and at least one carboxy group, wherein a hydrocarbon moiety thereof is a linear or branched moiety having 1 to 22 carbon atoms, and the hydrocarbon moiety optionally contains an oxygen atom(s); and wherein each $R^6$ independently represents a hydrogen atom or an organic group having 1 to 22 carbon atoms, and o represents an integer of 0 to 4.

It is preferred that o in the formula (III) be an integer of 1 to 4.

It is preferred that all of the $R^6$s in the formula (III) are hydrogen atoms.

It is preferred that $R^5$ in the formula (III) be a hydroxy hydrocarbon group.

In the formula (III), as for a hydroxy hydrocarbon group, a carboxy hydrocarbon group, and a hydroxycarboxy hydrocarbon group, it is preferred that a hydrocarbon in the hydrocarbon moiety, optionally containing an oxygen atom (s), be a saturated aliphatic hydrocarbon.

It is preferred that at least one of the $R^5$s in the formula (III) contain one hydroxy group, and that a hydrocarbon in the hydrocarbon moiety be a hydroxy hydrocarbon group of a saturated aliphatic hydrocarbon.

It is preferred that at least one of the $R^5$s in the formula (III) contain at least two hydroxy groups, and a hydrocarbon in the hydrocarbon moiety be a hydroxy hydrocarbon group of a saturated aliphatic hydrocarbon.

When at least one of the $R^6$s in the cation expressed as the formula (III) is a hydrogen atom, it is preferred that a proton of that hydrogen atom be originated from the component (B).

As for the respective preferable examples as shown in the formula (III), at least one of these combinations may be a more preferred embodiment(s).

It is a preferred embodiment for a cation, originated from the component (A) (a cation of the ammonium compound of the component (A)), to have a hydrocarbon group (preferably a saturated aliphatic hydrocarbon group) having at least one hydrogen-bonding functional group in terms of having advantages of the present invention, i.e., having high lubricity and low-corrosion properties, in addition to affinity for the surfaces of various materials such as metals, and affinity for water in a case being used as an aqueous lubricant composition.

In this case, it is preferred that at least one moiety in a cation, originated from the component (A) (a cation of the ammonium compound as the component (A)), into which a functional group can be introduced (atoms contained in chemical structures as basic skeletons, such as a nitrogen moiety, and a carbon moiety composing a ring together with nitrogen) be substituted by a hydrogen-bonding functional group-containing hydrocarbon group(s), and the rest of those moieties independently be hydrogen atoms or substituted by organic groups such as hydrocarbon groups (more preferably saturated aliphatic hydrocarbon groups)

Further, it is preferred that a cation originated from the component (A) (a cation of the ammonium compound of the component (A)) be a cation only composed of hydrogen-bonding functional group-containing hydrocarbon groups (more preferably saturated aliphatic hydrocarbon groups), a cation only composed of hydrogen-bonding functional group-containing hydrocarbon groups (more preferably saturated aliphatic hydrocarbon groups) and hydrogen atoms directly bonded to nitrogen or a cation only composed of hydrogen atoms; it is more preferred that the cation be a cation only composed of hydrogen-bonding functional group-containing hydrocarbon groups (more preferably saturated aliphatic hydrocarbon groups) or a cation only composed of hydrogen-bonding functional group-containing hydrocarbon groups (more preferably saturated aliphatic hydrocarbon groups) and hydrogen atoms directly bonded to nitrogen; and it is even more preferred that the cation be a cation only composed of hydrogen-bonding functional group-containing hydrocarbon groups (more preferably saturated aliphatic hydrocarbon groups) and hydrogen atoms directly bonded to nitrogen. The aforementioned hydrogen-bonding functional group is preferably a hydroxy group.

It is also a preferable embodiment for a cation originated from the component (A) (a cation of the ammonium compound of the component (A)) that the moiety of the component (A) into which a functional group can be introduced is only composed of hydrocarbon groups (more preferably saturated aliphatic hydrocarbon groups) and hydrogen atoms.

The cation as expressed by the formula (III) has a structure in which amines of the aforementioned component (A) are coupled to cationic residues such as hydrogen atoms. In a preferable embodiment, these cationic residues such as hydrogen atoms are originated from the component (B).

It is preferred, in terms of affinity for water and for the surfaces of various materials such as metals, lubricity in an aqueous environment, and foam suppression in actual use, that the total number of carbon atoms in the hydrocarbon groups (such as an alkyl groups) of the component (A) or those of the formula (I), (II) or (III) be 1 to 12, more preferably be 1 to 8, even more preferably be 1 to 6, particularly preferably be 1 to 4, most preferably be 1 to 3.

As for the additive or composition for imparting lubricity according to the present invention, an acid or a salt thereof of the component (B) has cationic and anionic residues. The cationic residues are hydrogen atoms, or groups (atom groups) that are bonded to nitrogen atom of the component (A) to be hydrogen-bonding functional groups or organic groups.

The hydrogen-bonding functional group in the component (B) may be contained in an anionic residue or a hydrogen atom serving as a proton in acid. It is preferred that the hydrogen-bonding functional group be contained at least in an anionic residue.

The acid of the component (B) as used herein not only includes a compound composed of a hydrogen atom(s), serving as a proton, and an anionic residue(s) but also non-exclusively includes a compound that reacts as a Lewis acid in the process of forming a salt with the component (A), and examples of which include a halogenated hydrocarbon, a dialkyl sulfuric acid, a dialkyl carbonate, an alkyl sulfonic acid and an alkyl phosphate ester, each of which optionally contains the aforementioned substituent group(s) (preferably an oxygen-containing group) in a hydrocarbon moiety. It is preferred that the acid of the component (B) be a compound composed of a hydrogen atom(s), serving as a proton, and an anionic residue(s).

Although not particularly limited, examples of the anion originated from an anionic residue of the component (B) include a halogen-based anion, a sulfur-based anion, a phosphorus-based anion, a cyano-based anion, a boron-based anion, a fluorine-based anion, a nitrogen oxide-based anion and a carboxylic acid-based anion, among which preferred are a halogen-based anion, a sulfur-based anion, a phosphorus-based anion, a boron-based anion, a fluorine-based anion, a nitrogen oxide-based anion and a carboxylic acid-based anion; and in terms of lubricity, more preferred are a halogen-based anion, a sulfur-based anion, a phosphorus-based anion, a boron-based anion, a fluorine-based anion and a carboxylic acid-based anion; even more preferred are a sulfur-based anion, a phosphorus-based anion and a carboxylic acid-based anion; particularly preferred are a sulfur-based anion and a carboxylic acid-based anion; and even more particularly preferred is a carboxylic acid-based anion.

It is preferred for an additive or composition for imparting lubricity according to the present invention to contain a hydrogen-bonding functional group in an anionic residue of component (B), and examples of the hydrogen-bonding functional group include those as already listed as a hydrogen-bonding functional group among which a hydroxy group, a carboxy group, a carboxylate group, an ether group, an alkoxy group, a sulfonyl group, a sulfonate group, a phosphate group and a phosphinic acid group are preferred.

Although not particularly limited, examples of the halogen-based anion include a fluorine ion, chloride ion, bromide ion, iodine ion and a fluorine-based anion.

Although not particularly limited, examples of the sulfur-based anion include a sulfonate anion, a hydrogen sulfonate anion, an aliphatic alkyl sulfonate anion (e.g. methane sulfonate anion, ethane sulfonate anion, butane sulfonate anion, 3-sulfopropyl methacrylate anion, 3-sulfopropyl acrylate anion), an aromatic alkyl sulfonate anion (e.g., benzene sulfonate anion, p-toluene sulfonate anion, 2,4,6-trimethylbenzene sulfonate anion, styrene sulfonate anion), a sulfate anion, a hydrogen sulfate anion and an alkyl sulfate anion (e.g. methyl sulfate anion, ethyl sulfate anion, butyl sulfate anion, octyl sulfate anion, 2-(2-methoxyethoxy)ethyl sulfate anion). Among these, preferred are an aliphatic alkyl sulfonate anion and an aromatic alkyl sulfonate anion, and more preferred are methane sulfonate anion and p-toluene sulfonate anion.

Although not particularly limited, examples of the phosphorus-based anion include a phosphate anion, a hydrogen phosphate anion, a dihydrogen phosphate anion, a phosphonate anion, a hydrogen phosphonate anion, a dihydrogen phosphonate anion, a phosphinate anion, a hydrogen phosphinate anion, an alkyl phosphate anion (e.g. dimethylphosphate anion, diethylphosphate anion, dipropylphosphate anion and dibutylphosphate anion), an alkyl phosphonate anion (e.g. methylphosphonate anion, ethylphosphonate anion, propylphosphonate anion, butylphosphonate anion and methylmethylphosphonate anion), an alkylphosphinate anion and a hexaalkylphosphate anion. Among these, a phosphate anion and a phosphinate anion are preferred. A phosphinate anion is more preferred in terms of lubricity, and a phosphate anion is more preferred in terms of safety.

Although not particularly limited, examples of the cyano-based anion include a tetracyanoborate anion, a dicyanamide anion, a thiocyanate anion and an isothiocyanate anion.

Although not particularly limited, examples of the boron-based anion include a tetraalkylborate anion such as tetrafluoroborate anion, bisoxalateborate anion and tetraphenylborate anion.

Although not particularly limited, examples of the fluorine-based anion include a bis(fluorosulfonyl)imide anion and a bis(perfluoroalkylsulfonyl)imide anion (e.g. bis(trifluoromethylsulfonyl)imide anion, bis(pentafluoroethylsulfonyl)imide, bis(heptafluoropropanesulfonyl)imide anion and bis(nonafluorobutylsulfonyl)imide), a perfluoroalkyl sulfonate anion (e.g. trifluoromethane sulfonate anion, pentafluoroethane sulfonate anion, heptafluoropropane sulfonate anion, nonaflate anion and perfluoro octane sulfonate anion), a fluorophosphate anion (e.g. hexafluorophosphate anion and tri(pentafluoroethyl)trifluorophosphate anion), a tris(perfluoroalkylsulfonyl)methide anion (e.g. tris(trifluoromethanesulfonyl)methide anion, tris(pentafluoroethanesulfonyl)methide anion, tris(heptafluoropropanesulfonyl)methide anion and tris(nonafluorobutanesulfonyl)methide anion), a fluorohydrogenate anion and a tetrafluoroborate anion.

Although not particularly limited, examples of the nitrogen oxide-based anion include a nitrate anion and a nitrite anion.

The aforementioned carboxylic acid-based anion is an organic acid anion that has, in one molecule, at least one carboxylic acid anion (—$COO^-$), and may contain an oxygen-containing group, a nitrogen-containing group, a sulfur-containing group, a phosphorus-containing group and/or a hydrocarbon group. Examples of such carboxylic acid-based anion include, but are not particularly limited to, a saturated or unsaturated aliphatic hydrocarbon group, a saturated or unsaturated alicyclic hydrocarbon group, and an aromatic hydrocarbon group as well as an anion having a carboxylic acid anion and a hydrocarbon group of any combination thereof. Specific examples of them include a saturated aliphatic carboxylic acid anion, an unsaturated aliphatic carboxylic acid anion, a saturated or unsaturated alicyclic carboxylic acid anion, an aromatic carboxylic acid anion, a saturated aliphatic hydroxycarboxylic acid anion, an unsaturated aliphatic hydroxycarboxylic acid anion, a saturated or unsaturated alicyclic hydroxycarboxylic acid anion, an aromatic hydroxycarboxylic acid anion, a carbonyl carboxylic acid anion, an alkyl ether carboxylic acid anion, a halogen carboxylic acid anion and an amino acid anion. (The number of carbon atoms in the carboxylic acid anions listed below include the number of carbon atoms in carboxy groups.)

The aforementioned saturated aliphatic carboxylic acid anion is comprised of a linear or branched aliphatic saturated hydrocarbon group and at least one carboxylic acid anion, may contain a carboxy group and a carboxylate group, and preferably has 1 to 22 carbon atoms. Although not particularly limited, specific examples thereof include anions obtained by dissociating protons from, for example, formic acid, acetic acid, propionic acid, butyric acid, valeric acid, caproic acid, enanthic acid, caprylic acid, pelargonic acid, capric acid, lauric acid, myristic acid, pentadecylic acid, palmitic acid, margaric acid, stearic acid, arachidic acid, heneicosylic acid, behenic acid, isobutyric acid, 2-methylbutyric acid, isovaleric acid, 2-ethylhexanoic acid, isononanoic acid, isopalmitic acid, isostearic acid, oxalic acid, malonic acid, succinic acid, glutaric acid, adipic acid, pimelic acid, suberic acid, azelaic acid and sebacic acid.

The aforementioned unsaturated aliphatic carboxylic acid anion is comprised of a linear or branched aliphatic unsaturated hydrocarbon group and at least one carboxylic acid anion, may contain a carboxy group and a carboxylate group, and preferably has 3 to 22 carbon atoms. Although not particularly limited, specific examples thereof include anions obtained by dissociating protons from, for example, acrylic acid, methacrylic acid, crotonic acid, palmitoleic acid, oleic acid, vaccenic acid, linoleic acid, linolenic acid, eleostearic acid, arachidonic acid, maleic acid and fumaric acid.

The aforementioned saturated or unsaturated alicyclic carboxylic acid anion is comprised of a non-aromatic saturated or unsaturated carbon ring and at least one carboxylic acid anion, and optionally contains a carboxy group and/or a carboxylate group and preferably has 6 to 20 carbon atoms. Particularly, a saturated alicyclic carboxylic acid anion having a cyclohexane ring skeleton is preferred; although not particularly limited, specific examples thereof include anions obtained by dissociating protons from, for example, cyclohexanecarboxylic acid and cyclohexanedicarboxylic acid.

The aforementioned aromatic carboxylic acid anion is comprised of one or multiple aromatic rings and at least one carboxylic acid anion, and optionally contains a carboxy group and/or a carboxylate group and preferably has 6 to 20 carbon atoms. Particularly, an aromatic carboxylic acid anion having a benzene ring skeleton is preferred; although not particularly limited, specific examples thereof include anions obtained by dissociating protons from, for example, benzoic acid, cinnamic acid, phthalic acid, isophthalic acid and terephthalic acid.

The aforementioned saturated aliphatic hydroxycarboxylic acid anion is comprised of a linear or branched aliphatic saturated hydrocarbon group, at least one carboxylic acid anion and at least one hydroxy group, may contain a carboxy group and a carboxylate group, and preferably has 2 to 24 carbon atoms. Particularly, a saturated aliphatic hydroxycarboxylic acid anion having 1 to 4 hydroxy groups and 2 to 7 carbon atoms is preferred. Although not particularly limited, specific examples thereof include anions obtained by dissociating protons from, for example, glycolic acid, lactic acid, tartronic acid, glyceric acid, hydroxyacetic acid, hydroxybutyric acid, 2-hydroxydecanoic acid, 3-hydroxydecanoic acid, 12-hydroxystearic acid, dihydroxystearic acid, cerebronic acid, malic acid, tartaric acid, citramalic acid, citric acid, isocitric acid, leucine acid, mevalonic acid and pantoic acid.

The aforementioned unsaturated aliphatic hydroxycarboxylic acid anion is comprised of a linear or branched aliphatic unsaturated hydrocarbon group, at least one carboxylic acid anion and at least one hydroxy group, and optionally contains a carboxy group and/or a carboxylate group and preferably has 3 to 22 carbon atoms. Although not particularly limited, specific examples thereof include anions obtained by dissociating protons from, for example, ricinolic acid, ricinoleic acid, and ricineraidic acid.

The aforementioned saturated or unsaturated alicyclic hydroxycarboxylic acid anion is comprised of a non-aromatic saturated or unsaturated carbon ring, at least one carboxylic acid anion and at least one hydroxy group, and optionally contains a carboxy group and/or a carboxylate group and preferably has 4 to 20 carbon atoms. Particularly, an alicyclic hydroxycarboxylic acid anion having a six-membered ring skeleton and 1 to 4 hydroxy groups is preferred; although not particularly limited, specific examples thereof include anions obtained by dissociating protons from, for example, hydroxycyclohexanecarboxylic acid, dihydroxycyclohexanecarboxylic acid, quinic acid (1,3,4,5-tetrahydroxycyclohexanecarboxylic acid) and shikimic acid. Further, anions obtained by dissociating protons from hydroxy group-containing cyclic lactones may also be preferably used; although not particularly limited, specific examples thereof include anions obtained by dissociating protons from, for example, ascorbic acid and erythorbic acid.

The aforementioned aromatic hydroxycarboxylic acid anion is comprised of one or multiple aromatic rings, at least one carboxylic acid anion and at least one hydroxy group, and optionally contains a carboxy group and/or a carboxylate group and preferably has 6 to 20 carbon atoms. Particularly, an aromatic carboxylic acid anion having a benzene ring skeleton and 1 to 3 hydroxy groups is preferred; although not particularly limited, specific examples thereof include anions obtained by dissociating protons from, for example, salicylic acid, hydroxybenzoic acid, dihydroxybenzoic acid, trihydroxybenzoic acid, hydroxymethylbenzoic acid, vanillic acid, syringic acid, protocatechuic acid, gentisic acid, orsellinic acid, mandelic acid, benzylic acid, atrolactic acid, phloretic acid, coumaric acid, umbellic acid, caffeic acid, ferulic acid and sinapic acid.

The aforementioned carbonyl carboxylic acid anion is a carboxylic acid anion having a carbonyl group(s) in a molecule and having 3 to 22 carbon atoms and optionally containing a carboxy group and a carboxylate group; preferred is a carbonyl carboxylic acid anion having 1 to 2 carbonyl groups and 3 to 7 carbon atoms. Particularly, preferred is a carbonyl carboxylic acid anion represented by $CH_3((CH_2)_pCO(CH_2)_q)COO^-$ (p and q each represent an integer of 0 to 2). Although not particularly limited, specific examples thereof include anions obtained by dissociating protons from, for example, pyruvic acid.

The aforementioned alkyl ether carboxylic acid anion is a carboxylic acid anion having an ether group(s) in a molecule, optionally containing a carboxy group and/or a carboxylate group, and having 2 to 22 carbon atoms, including a polyoxyalkylene alkyl ether carboxylic acid anion(s); preferred is an alkyl carboxylic acid anion having 1 to 2 ether groups and 2 to 12 carbon atoms. Particularly, preferred is an alkyl ether carboxylic acid anion or polyoxyethylene alkyl ether carboxylic acid anion represented by $CH_3(CH_2)_rO(CH_2)_sCOO^-$ (r and s each represents an integer of 0 to 4). Although not particularly limited, specific examples thereof include anions obtained by dissociating protons from, for example, methoxyacetic acid, ethoxyacetic acid, methoxybutyric acid and ethoxybutyric acid.

The aforementioned halogen carboxylic acid anion optionally contains a carboxy group and/or a carboxylate group, and a halogen carboxylic acid anion having 2 to 22 carbon atoms is preferred. Although not particularly limited, specific examples thereof include anions obtained by dissociating protons from, for example, fluorine-substituted halogen carboxylic acids such as trifluoroacetic acid, trichloroacetic acid, tribromoacetic acid, pentafluoropropionic acid, pentachloropropionic acid, pentabromopropionic acid, perfluorononanoic acid, perchlorononanoic acid and perbromononanoic acid.

Although not particularly limited, examples of the aforementioned amino acid anion include anions obtained by dissociating protons from, for example, glycine, alanine, glutamic acid, arginine, asparagine, aspartic acid, isoleucine, glutamine, histidine, cysteine, leucine, lysine, proline, phenylalanine, threonine, serine, tryptophan, tyrosine, methionine, valine, sarcosine, aminobutyric acid, methylleucine, aminocaprylic acid, aminohexanoic acid, aminocapric acid, aminolauric acid, aminomyristic acid, aminopalmitic acid, aminostearic acidnorvaline, aminovaleric acid, aminoisobutyric acid, thyroxine, creatine, ornithine, opine, theanine, tricholomine, kainic acid, domoic acid, ibotenic acid, acromelic acid, cystine, hydroxyproline, hydroxylysine, thyroxin, phosphoserine, desmosine.beta-alanine, citrulline, creatine and trimethylglycine.

Examples of the salts of the component (B) include salts of the aforementioned anions with cations (such as alkali metal cations, alkali earth metal cations or ammonium cations).

In terms of enhancing lubricity, an anion having a hydrocarbon group(s) is preferred among the anions originated from anionic residues of component (B), among which more preferred are anions having a saturated or unsaturated aliphatic hydrocarbon group(s) or an aromatic group(s), and the hydrocarbon group thereof preferably has 1 to 22 carbon atoms, more preferably 3 to 22 carbon atoms, even more preferably 8 to 22 carbon atoms. Although not particularly limited, there may be used a carboxylic acid anion having a saturated or unsaturated aliphatic hydrocarbon group or an aromatic group, among which a saturated or unsaturated aliphatic carboxylic acid anion is preferred, and an unsaturated aliphatic carboxylic acid anion is more preferred. In terms of having a low coagulation point, an unsaturated aliphatic carboxylic acid anion is preferred, and examples of which include, but are not particularly limited to, an oleic acid anion, linoleic acid anion, linolenic acid anion, palmitoleic acid anion, vaccenic acid anion, eleostearic acid anion and arachidonic acid anion. In terms of lubricity, coagulation point and industrial availability, preferred are an oleic acid anion and a linoleic acid anion, and an oleic acid anion is more preferred. Meanwhile, in terms of affinity for the surfaces of various materials such as metals or affinity for water, lubricity in an aqueous environment, and foam suppression in actual use, it is preferred that the number of carbon atoms in the hydrocarbon group of the component (B) be 1 to 22, more preferably 1 to 12, even more preferably 1 to 10, particularly preferably 1 to 8, most preferably 1 to 6.

In a case where the component (B) is of a polybasic acid, the composition of the components (A) and (B) may be that in which the valence of components (A) is equivalent to, less than, or more than or equal to, the valence of component (B) (if the component (B) is of a polybasic acid, it may be a partially or fully neutralized salt). It is preferred for the composition of the components (A) and (B) that the valence of components (A) is equivalent to the valence of components (B).

In a case, for example, where the component (B) is of a dibasic acid and the valence of the component (A) is one, the mixing molar ratio of component (A) and the component (B) may be 1:1 to 2:1. Further two or more species may be used for the component (A). Particularly, an additive for imparting lubricity with a molar composition ratio of 2:1 (fully neutralized salt) has a neutral pH which allows minimization of corrosion by the acid of the component (B), and if the component (A) has a hydrogen-bonding functional group(s), it allows the effects of these hydrogen-bonding functional groups to be improved. If the components (A) and (B) form an ammonium salt, two molecules of cations, originating from the component (A), can be introduced into one molecule salt, which therefore allows further improvement in the effects of the hydrogen-bonding functional group which is introduced into the component (A).

Particularly in an aqueous environment, in order to form a molecular film with the help of affinity for the surfaces of various materials such as metals for improving high lubricity and low-corrosion property which are advantages of the present invention, it is preferred, in a case of a mixture or salt of the components (A) and (B), that either one of the anion and cation in the mixture or salt of the components (A) and (B) have a hydrogen-bonding functional group the forms a hydrogen bond, a coordinate bond or an ion bond, and it is more preferred that both of them have a hydrogen-bonding functional group. Further, it is preferred that one of them have a hydrocarbon group (preferably a saturated or unsaturated aliphatic hydrocarbon group and an aromatic group, more preferably a saturated or unsaturated aliphatic hydrocarbon group). Preferable hydrogen-bonding functional groups in the component (A) are as listed above, and examples of the hydrogen-bonding functional group in the component (B) include an oxygen-containing group, a nitrogen-containing group, a sulfur-containing group, and a phosphorus-containing group, among which preferred are a hydroxy group, a carboxy group, a carboxylate group, an ester group, an ether group, an alkoxy group, a carbonyl group, an amino group, a sulfonyl group, a sulfonate group, a sulfate ester group, a phosphate group, a phosphinic acid group, and a phosphate ester group; more preferred are a hydroxy group, a carboxy group, a carboxylate group, an ester group, an ether group, an alkoxy group, a carbonyl group, a sulfonyl group, a sulfonate group, a phosphate group, and a phosphinic acid group; and even more preferred are a hydroxy group, a carboxy group, a carboxylate group, an ester group, an ether group, an alkoxy group, a sulfonyl group, a sulfonate group, a phosphate group, and a phosphinic acid group; and particularly preferred is a hydroxy group.

Further, in terms of safety and usage, it is preferred that the component (B) employ, as a raw material(s), compounds listed in Japanese standards of quasi-drug ingredients (JSQI), Japanese standards of quasi-drug additives, Japanese pharmacopoeia (JP), Japanese pharmaceutical codex (JPC), Japanese pharmaceutical excipients (JPE) and Japan's specifications and standards for food additives (JSFA), and preferable examples of which include, but are not particularly limited to, an acetic acid, caprylic acid, capric acid, lauric anion, myristic anion, palmitic anion, stearic acid, oleic acid, linoleic acid, lactic acid, glycolic acid, succinic acid, citric acid, hydrochloric acid, fumaric acid, phosphoric acid, and ascorbic acid. Moreover, examples of the amino acid that can be used in both of the components (A) and (B) include a glycine, alanine, arginine, aspartic acid, histidine, cysteine, proline, serine, tryptophan, tyrosine, methionine, aminobutyric acid, aminohexanoic acid, cystine, glutamic acid, isoleucine, phenylalanine, threonine, tryptophan, methionine, valine and theanine.

Further, in terms of high lubricity and low-corrosion properties of the additive or composition for imparting lubricity according to the present invention, the compounding molar ratio between the component (A) and the component (B) may be 1:99 to 99:1, and is not particularly limited. It is preferred that the ratio be 1:9 to 9:1, more preferably be 1:5 to 5:1, and even more preferably be 1:2 to 2:1.

As for the additive or composition for imparting lubricity of the present invention, it may be provided that the mixture or salt of the components (A) and (B) is in an anhydrous state (anhydride) or a hydrate that has absorbed the water in the air. A hydrate refers to a compound whose moisture rate has reached a saturated state after being left in the air at 25° C. and absorbing the water therein. A compound that does not absorb water when left in the air at 25° C. is not a hydrate, but an anhydride.

As for the additive or composition for imparting lubricity of the present invention, an anhydride and hydrate of the mixture or salt of the components (A) and (B) may be either a liquid or a solid at 25° C. However, when it is used at a temperature of from low to room temperature, it is preferred that the coagulation point of the anhydride or hydrate be less than 25° C., more preferably be −5° C., even more preferably be −10° C. in terms of forming a uniform layer of liquid at an interface therebetween without causing any precipitation or deposition of solids to thereby improve the lubricant property. Conventional lubricants such as those of polyethyleneglycol volatilize when they are subjected to a high-temperature treatment, while the mixture or salt of the components (A) and (B) which is a liquid at 25° C. and used in the present invention does not volatilize by virtue of its structural aspect, and retains characteristics of liquid, thus allowing its lubricious property to be maintained even under a volatile condition. As for the additive or composition containing water, it can retain lubricity due to the liquid uniformly distributed on a lubrication surface without any solids being deposited or coagulated even after the water has been evaporated as a result of long period of use under a heating condition.

In view of the above, the additive or composition for imparting lubricity according to the present invention is excellent in terms of that it may be used for a variety of applications since it does not evaporate nor be coagulated when it is used in a wide range of temperature from low to high temperatures.

Further, the additive or composition for imparting lubricity according to the present invention is involatile and excellent in terms of lubricity, thermal stability, and oxidation stability, and therefore may steadily reduce frictions between solids to thereby restrain a friction heat or a heat to be generated during metallic processing, thus inhibiting generation of fire or smoke. Furthermore, as the additive or composition for imparting lubricity according to the present invention is involatile and has no flashing point, a solution or hydrate of the mixture or salt of the components (A) and (B) contains water and therefore has no flashing point, which therefore improves the workability of the same. Of particular note, as the additive or composition for imparting lubricity according to the present invention contains a hydrogen-bonding functional group, it is excellent in specific heat and heat conductivity as well as in cooling efficiency.

The additive or composition for imparting lubricity according to the present invention is excellent in washability since it does not form a bubble due to its structural characteristics, in contract to the conventional aqueous lubricating composition that employs an oil-based lubricant, and has a hydrogen-bonding functional group in either one or both components of (A) and (B) and has a high affinity with water, which allows itself to be rinsed with water without employing any special washing (e.g., washings with degreasing processes, organic solvents, or washing agents). Moreover, when the composition is used as an aqueous lubricating composition, it can be kept in a uniform state without causing it to be separated into oil and water layers, and the composition containing a surfactant agent can also retain its uniform state. In view of the above, the additive or composition according to the present invention have a high degree of industrial applicability.

The additive or composition for imparting lubricity according to the present invention may also be used as a base oil or an additive. It may also be used as an additive such as an oiliness agent, extreme pressure agent, flow point depressant, antiwear agent, viscosity index improvement agent, anti-corrosion agent, rust inhibitor, metal inactivation agent, and antifungal agent.

The additive or composition for imparting lubricity according to the present invention may be used in a mixture with a further component(s) in addition to the components (A) and (B) as long as the advantages of the present invention are not impaired. Examples of such further components include, but are not particularly limited to, solvents such as water, alcohols, and organic solvents; further lubricants, and additives for improving or imparting functionalities, and specific examples of which include, but are not particularly limited to, surfactants, antioxidants, oiliness agents, extreme pressure agents, antiwear agents, detergent dispersants, viscosity index improvers, corrosion inhibitors, rust inhibitors, metal deactivators, antifoaming agents, fluid point depressants, demulsifier, and antifungal agents.

Examples of such further lubricants include aqueous lubricants and oil-based lubricants, and examples of the aqueous lubricants include, but are not particularly limited to, polyethylene glycol and polypropylene glycol. Examples of the oil-based lubricants include, but are not particularly limited to, synthetic hydrocarbon oils such as poly-α-olefin copolymers or hydrogenated products thereof, ethylene-α-olefin copolymers or hydrogenated products thereof, alkyl benzenes and alkyl naphthalenes; mineral oils such as aromatic hydrocarbons, paraffin-based hydrocarbons and napthenic hydrocarbons; synthetic esters such as polyol esters (e.g., trimethylolpropane olate, neopentyl glycol olate, pentaerythritol olate, and 2-ethylhexyl oleate), dibasic esters, aromatic multivalent carboxylate esters, phosphate esters, phosphite esters and carbonate esters; and animal/vegetable oils and fats such as beef fat, pork fat, canola oil, castor oil and palm olein.

Surfactants may be of general surfactants, which are not particularly limited. Such surfactants may be appropriately selected from a nonionic surfactant, an anionic surfactant, a cationic surfactant, an amphoteric surfactant and a silicone-based surfactant, among which preferred are a nonionic surfactant, an anionic surfactant and a cationic surfactant, and more preferred is a nonionic surfactant. Any one of them may be used alone, or two or more of them may be used in combination.

Examples of the nonionic surfactant include a polyglycerin fatty acid ester, a polyoxyethylene sorbitan fatty acid ester, a polyoxyethylene sorbit fatty acid ester, a polyoxyethylene lanolin/lanolin alcohol/beeswax derivative, a polyoxyethylene castor oil/hardened castor oil, a polyoxyethylene sterol/hydrogenated sterol, a polyoxyethylene alkyl ether, a polyoxyethylene polyoxypropylene alkyl ether a polyethylene glycol fatty acid ester, a polyoxyethylene glyceryl isostearate, sorbitan fatty acid esters, a glycerin fatty acid ester, a diglycerin fatty acid ester, and a polyglyceryl fatty acid ester.

Although not particularly limited, examples of the anionic surfactant include an alkyl benzene sulfonate, an alkylnaphthalenesulfonate, an alkylsulfonate salt, a α-olefin sulfonate, an alkyl sulfate, an alkylsulfate ester salt, an alkyl ether phosphate, a N-acyl amino acid salt, an alkyl aryl sulfonate, an alkyl ether sulfate, an alkylamide sulfate, an alkyl phosphate, alkylphosphonic acid or its salts, an alkylamide phosphate, an alkyloylalkyltaurine salt, a fatty acid salt, a polyoxyethylene alkyl ether acetate, a sodium coconut fatty acid methyltaurate, a polyoxyethylenealkyl ether sulfate, a phosphate ester salt, a polyoxyethylene alkyl ether phosphate, a dialkyl sulfosuccinate, a perfluoroalkyl-phosphoric acid ester, a N-acyl-L-glutamate and a N-acyl-L-arginine ethyl-DL-pyrrolidone carboxylate. Specific examples thereof include sodium deoxycholate, sodium lauryl sulfate, sodium laureth sulfate, sodium myristyl sulfate, sodium cetyl sulfate, sodium oleyl sulfate, sodium dodecylbenzenesulfonate, sodium 1,2-dihydroxypropanesulfonate, sodium polyoxyethylene laurylether acetate and sodium coconut oil fatty acid N-acylglutamate.

Although not particularly limited, examples of the cationic surfactant include, a mono-alkyl trimethyl ammonium salt, a dialkyl dimethyl ammonium salt, alkylpyridinium salt, a N,N-dialkyloyloxyethyl-N-methyl ammonium salt, a N-hydroxyethyl ammonium salt, an alkylamine salt, and a stearyldimethylbenzylammonium salt.

Although not particularly limited, examples of the amphoteric surfactant include an alkylbetaine, a fatty acid amide propyl betaine, a lauryl hydroxysulfobetaine, 2-alkyl-N-carboxymethyl-N-hydroxyethylimidazolinium betaine, a lecitin, a hydrogenated lecitin, an alkyloxyhydroxypropyl arginine hydrochloride, lauryl hydroxysultaine, lauriminodipropionate, undecyl hydroxyethyl imidazolinium betaine sodium, disodium lauriminodiacetate, lauryl dimethyl amino acetic acid betaine, N-[3-alkyloxy-2-hydroxypropyl]-L-arginine hydrochloride, alkyl hydroxy sulfobetaine, alkyldimethy amine oxide, sodium alkylamino dipropionate, dihydroxyalkyl methylglycine, and sodium lauryl diaminoethylglycinate.

Although not particularly limited, examples of the silicone-based surfactant include PEG-10 dimethicone, PEG/PPG-20/20 dimethicone, polysilicone-13 and lauryl polyglyceryl-3 polydimethylsiloxyethyl dimethicone.

Although not particularly limited, there may be used an antioxidant that has been used in a conventional hydrocarbon-based lubricating oil, examples of which include an amine-based antioxidant, a phenol-based antioxidant, a phosphorus-based antioxidant, and a sulfur-based antioxidant. Any of these antioxidants may be used alone or two or more of them may be used in combination.

Examples of the oiliness agents include, but are not particularly limited to, aliphatic alcohols; fatty acid compounds such as fatty acids or metal salts of fatty acids; ester compounds such as polyol esters, sorbitan esters and glycerides; and amine compounds such as aliphatic amines.

Examples of the extreme pressure agents include, but are not particularly limited to, a sulfur-based extreme pressure agent, a phosphorus-based extreme pressure agent, an extreme pressure agent containing sulfur and a metal, and an extreme pressure agent containing phosphorus and a metal. Any of these extreme pressure agents may be used alone or two or more of them may be used in combination. The extreme pressure agent may be any extreme pressure agent, as long as the extreme pressure agent contains sulfur atoms and/or phosphorus atoms in its molecule and as long as the extreme pressure agent can provide load bearing effects and wear resistance. Examples of the extreme pressure agent containing sulfur in its molecule include, but are not particularly limited to, sulfurized fat and oil, sulfurized fatty acid, ester sulfide, olefin sulfide, dihydrocarbyl polysulfide, a thiadiazole compound, an alkylthiocarbamoyl compound, a triazine compound, a thioterpene compound, a dialkylthiodipropionate compound and the like.

Examples of the detergent dispersant include, but are not particularly limited to, metal sulfonates, metal salicylates, metal phenates, and succinimide.

Examples of the viscosity index improver include, but are not particularly limited to, a polymethacrylate, dispersed polymethacrylate, olefin copolymer (e.g. an ethylene-propylene copolymer), dispersive olefin copolymer, and styrene copolymer (e.g. a hydrogenated styrene-diene copolymer).

Examples of the corrosion inhibitors include, but are not particularly limited to, a nitrogen-containing compound (e.g., benzotriazole and the derivative thereof, and 2,5-dialkylmercapto-1,3,4-thiadiazole) and zinc dithiophosphate.

Examples of the rust inhibitor include metal sulfonates and succinic acid esters.

Examples of the metal deactivator include benzotriazole and thiadiazole.

Examples of the antifoaming agent include methylsilicone oil, fluorosilicone oil, and polyacrylates.

The inventive additive of the additive or composition according to the present invention is mainly directed to an additive to be mixed in any process(es) of manufacturing an intended composition. The additive as used herein refers to the one having components (A) and (B) being added thereto. The expression being that the components (A) and (B) are "added" as used herein encompasses a case in which the components (A) and (B) have been added thereto before finally obtaining the additive. The expression also encompasses a case in which a salt is formed by the components (A) and (B) serving as starting materials, and the salt is used as an additive, and a case in which the aforementioned salt is mixed, as needed, with further components such as water to make an additive. The additive as used herein may be a mixture composed only of the components (A) and (B) (including a case in which the salts thereof are contained), or a compound further containing components, such as water, other than the components (A) and (B) and their salts.

The inventive composition of the additive or composition according to the present invention is mainly directed to an intended final composition. The composition as used herein encompasses a case of a final composition that is manufactured by adding the additive of the present invention in any process(es) therefore. The composition as used herein is not limited to the case where the inventive composition is utilized but any composition containing the components (A) and (B) qualifies as such composition. For example, the composition as used herein also encompasses a composition where the components (A) and (B) are blended separately to manufacture an intended final composition. That is, mixing sequence of the component (A), the component (B) and further component(s) is not limited, and the inventive composition refers to the one in which the components (A) and (B) have been added thereto by the time when the composition has been finally prepared.

The components (A) and (B) in the additive or composition for imparting lubricity may be blended in any ratio, and the compounding content thereof in total may be, although not particularly limited, in terms of lubricity, 0.01 to 100% by mass, more preferably 0.1 to 100% by mass, even more preferably 1 to 100% by mass and particularly preferably 10 to 100% by mass.

(Aqueous Additive or Composition)

A preferable example of the additive or composition for imparting lubricity is directed to a water-containing (aqueous) additive or composition with at least water being further added therein. In a preferable embodiment, such additive or composition is an aqueous solution.

In a case where the additive or composition for imparting lubricity according to the present invention is a water-containing (aqueous) additive or composition, the hydroxy hydrocarbon group contained in the component (A) has at least one hydroxy group for the sake of lubricity, and the hydrocarbon moiety thereof is a linear or branched moiety having, preferably 1 to 22 carbon atoms, more preferably 1 to 18 carbon atoms, even more preferably 1 to 12 carbon atoms, particularly more preferably 1 to 6 carbon atoms.

It is preferred, in terms of affinity with water and to surfaces of various materials such as metals, foam suppression functionality and washability, that the total number of carbon atoms in the organic groups of the component (A) be 1 to 22, more preferably be 1 to 18, even more preferably be 1 to 12, particularly preferably be 1 to 8, most preferably be 1 to 4.

It is preferred, in terms of affinity with water and to surfaces of various materials such as metals, lubricity in an aqueous environment, and foam suppression in actual use, that the number of carbon atoms in the hydrocarbon groups (such as an alkyl groups) of the component (B) be 1 to 22, more preferably be 1 to 12, even more preferably be 1 to 10, particularly preferably be 1 to 8, most preferably be 1 to 6.

The aqueous additive or composition is excellent in cooling capacity and thus restrains the generation of heat, fire and smoke on top of which the additive or composition allows itself to reduce viscosity which in turn leads to an improvement in workability. Particularly, the additive for imparting lubricity according to the present invention contains a hydrogen-bonding functional group which allows itself to have a heat conductivity that is superior to that in which water alone is utilized. Further, the addition of water enhances a specific heat thereof which enables formation of an aqueous additive or composition that is particularly excellent in cooling capacity.

The compounding content of the components (A) and (B) in the additive or composition for imparting lubricity may be, although not particularly limited, for example, 0.01 to 99.99% by mass in total in terms of lubricity. The content is more preferably 0.1 to 99.99% by mass, even more preferably 1 to 99.99% by mass and particularly preferably 10 to 99.99% by mass.

(Additive or Composition Containing Surfactant/Additive or Composition Containing Water and Surfactant)

A preferable example of the additive or composition for imparting lubricity is directed to an additive or composition further containing at least a surfactant.

An additive or composition containing a surfactant improves affinity to an oil-based additive and enhances the lubricity, which therefore makes such additive or composition useful.

The additive or composition containing a surfactant, by virtue of having a hydrogen-bonding functional group in at least one of the components (A) and (B), allows itself to be a composition that is excellent in affinity to the surfactant to thereby provide a uniform composition serving as a solution, emulsion or dispersing liquid, as well as that it is excellent in lubricity and stability as a composition The compounding content of the surfactant in the additive or composition of the present invention may be, in terms of stability of the composition or lubricity, although not particularly limited, 0.01 to 50% by mass, more preferably 0.1 to 30% by mass, even more preferably 0.1 to 10% by mass.

Among the aforementioned surfactants, preferred is a non-ionic surfactant in terms of stability of the additive or composition. Further, an additive or composition containing a surfactant has a low coagulation point which is highly advantageous in terms of usability.

A preferable example of the additive or composition for imparting lubricity according to the present invention is directed to an additive or composition further containing at least a surfactant and water.

The additive or composition having water and a surfactant is excellent in cooling capacity and thus restrains generation of heat, fire and smoke which are generated during metallic processing on top of which the additive or composition allows itself to reduce viscosity which in turn leads to an improvement in workability. Further, it allows favorable affinity to an oil-based additive or composition to further enhance the lubricity, which is useful.

The components (A) and (B) to be used in the additive or composition having water and a surfactant may take up the preferable structures as mentioned above, and it is preferable to employ the components (A) and (B) having a hydrogen-bonding functional group in at least either one of them.

It is preferred, in terms of affinity with water and to surfaces of various materials such as metals, and foam suppression in use of an aqueous environment, that the number of carbon atoms (if the component (B) contains an alkyl group) in the alkyl group of the component (B) be 1 to 22, more preferably be 1 to 12, even more preferably be 1 to 10, particularly preferably be 1 to 8, most preferably be 1 to 6. Meanwhile, it is preferred, in terms of enhancing lubricity and forming a uniform composition as an emulsion or dispersing liquid, that the component (B) have a saturated or unsaturated aliphatic hydrocarbon group, and more preferred is an unsaturated aliphatic hydrocarbon group. It is also preferred that the number of carbon atoms in these hydrocarbon group be 6 to 22, more preferably 8 to 22, even more preferably 12 to 18.

The surfactants may be appropriately selected from a nonionic surfactant, an anionic surfactant, a cationic surfactant, an amphoteric surfactant and a silicone-based surfactant, as mentioned above, among which preferred are a nonionic surfactant, an anionic surfactant and a cationic surfactant, and more preferred is a nonionic surfactant. It is preferred that the compounding content of the surfactant in the additive or composition containing an additive, a surfactant and water for imparting lubricity of the present invention be, although not particularly limited, for example, 0.01 to 50% by mass, more preferably 0.1 to 30% by mass, and even more preferably 0.1 to 10% by mass, and it is preferred that the total compounding content of the components (A) and (B) be, although not particularly limited, for example, 0.01 to 99.99% by mass, more preferably 0.1 to 99.99% by mass, even more preferably 1 to 99.99% by mass, particularly more preferably 10 to 90% by mass.

(Lubricating Composition Containing Surfactant and Oil-Based Lubricant)

A preferable example of the additive or composition for imparting lubricity according to the present invention is directed to an additive or composition containing at least a surfactant and an oil-based lubricant, or even optionally containing water.

Its characteristics are not particularly limited and may be a diapering liquid, emulsion or solution which exhibits a high lubricity.

The components (A) and (B) to be used in this example may take up the preferable structures as mentioned above, and it is preferred that the component (A) have a hydrogen-bonding functional group and that the component (B) have a hydrogen-bonding functional group.

The above-mentioned surfactants may be used therein, and the compounding content of them in the additive or composition according to the present invention, in terms of lubricity or stability of the composition, may be, although not particularly limited to, for example, 0.01 to 50% by mass, more preferably 0.1 to 30% by mass, and even more preferably 0.1 to 10% by mass.

The above-mentioned oil-based lubricants may be used therein, and it is preferred that the compounding content of them in the additive or composition according to the present invention be, although not particularly limited to, not smaller than 10% by mass, and more preferably not smaller than 20% by mass.

The components (A) and (B) or their ammonium salts in the additive or composition may be used as, for example, a base oil, additive or solvent, and their compounding content in terms of lubricity may be, although not particularly limited to, for example, 0.01 to 99.99% by mass, more preferably, 0.1 to 99.99% by mass, even more preferably 1 to 99.99% by mass, particularly preferably 10 to 99.99% by mass based on the total amount of the components (A) and (B). The components (A) and (B) to be used in the additive or composition according to the present invention may take up the preferable structures as mentioned above, and it is preferred that the component (A) be the one having a hydrogen-bonding functional group and that the component (B) be the one having a hydrogen-bonding functional group. The ammonium salts to be used in the additive or composition according to the present invention may take up the preferable structures as mentioned above, and it is preferred that the cation thereof have a hydrogen-bonding functional group and that the anion thereof have a hydrogen-bonding functional group.

The four types of additive or composition as mentioned above may be either liquid or solid at 25° C. but it is preferable for the mixture or salt of the components (A) and (B) to have a coagulation point of less than 25° C., more preferably less than −5° C., particularly preferably less than −10° C. in terms of forming a uniform layer of liquid at an interface therebetween without causing precipitation or deposition of solids even when it is used at a temperature of from low to room temperature to thereby improve the lubricating property. It is preferable for the mixture or salt of the components (A) and (B) to have a freezing-point depressant effect for sake of lowering the coagulation point of the lubricating composition.

(Utility)

The additive or composition according to the present invention has a high lubricity as well as low corrosion property which enables itself to be suitably used for the following purposes.

The additive or composition according to the present invention may be used for a variety of applications to which improvement is required in lubricity, anti-wear property, or spreadability on a material surface of a moving or contacting part that is made of a material including, but not limited to, for example, metal (including non-iron metal), alloy, mineral, resin, rubber, wood, paper, and paint.

As a typical example, although not particularly limited, the additive or composition according to the present invention may be used for the sake of, for example, reducing both or either one of friction and heat in mechanical moving parts. Examples of such applications include, but are not particularly limited to, applications to or as a hydraulic oil, bearing oil, gear oil, clutch or brake. These are used, for example, in transportation equipment such as automobiles, motorcycles, trains, and ships; construction machinery such as generator engines, cranes, excavators; food machinery such as food manufacturing/processing equipment, refrigeration/freezing equipment, heating equipment, packaging machinery and transportation machinery; thermal, nuclear, hydro, wind, or other power generation equipment; manufacturing facilities such as those for chemical manufacturing, resin processing, pulp/paper manufacturing, cement manufacturing; metal processing machinery for various metals; drive units for inkjet printers; fuel injection equipment for, e.g., internal combustion engines; injection equipment for, e.g., emulsification/dispersion equipment; base materials for biomaterials such as artificial joints; and lubrication layers to be used for magnetic heads and magnetic disks of hard disk recording materials.

The additive or composition according to the present invention may be used for metallic processing. Specific examples of such include, but are not particularly limited to, forming, wire drawing, drawing, pressing, rolling, cutting, grinding, polishing, and plastic processing. Further, the additive or composition according to the present invention may be used for various applications such as cosmetics, paints, inks, adhesives, antifoaming agents, detergents, cosmetics, resin additives, and surface treatment agents.

If the additive or composition according to the present invention is of a water-containing additive or composition which is to be used for the purpose of, for example, although not particularly limited to, pressing or forming where lubricating capacity is of great importance in metallic processing, the compounding content of the additive or composition according to the present invention is, for example, not smaller than 20% by mass, more preferably not smaller than 60% by mass, even more preferably not smaller than 80% by mass based on the total 100% by mass of the lubricating composition that contains water.

The additive according to the present invention is used as an additive for the intended final composition. Specifically, although not particularly limited, it may be used as an extreme pressure agent, antiwear agent, detergent dispersant, viscosity index improver, corrosion inhibitor, rust inhibitor, metal deactivator, antifoaming agent, fluid point depressant, demulsifier, and antifungal agent.

The additive or composition according to the present invention has low kinetic and static friction coefficients, is excellent in lubricity, anti-wear property, or spreadability during or at the start of operation, and is usable in a wide range of temperature of not only room temperature but also of low to high temperatures in view of the low flashing point, low coagulation point, non-volatility and liquidity thereof. The additive or composition is also excellent in low-corrosion property, low-temperature fluidity, thermal conductivity, thermal stability, and oxidative stability, and has a high flashing point, which allow it to be used for a variety of lubricating purposes.

Although embodiments of the present invention have been described heretofore, the present invention shall not be limited to these embodiments, and various modifications can be made without departing from the scope of the invention. Further, as for the respective preferred examples as shown in formula (I), the respective preferred examples as shown in formula (II) or the respective preferred examples as shown in formula (III), at least one of the combinations of the above may be a more preferred embodiment based on the results of the working examples. Further, as for the respective preferred examples as shown in formulae (I) to (III), at least one combination of all of the above may be a more preferred embodiment based on the results of the working examples. Furthermore, a combination of these with the respective preferred examples as shown with respect to their anions as well as a combination of these with a mixture or salt of the components (A) and (B) may be a more preferred embodiment based on the results of the working examples.

WORKING EXAMPLES

The present invention is described in greater detail hereunder with reference to working examples. However, the invention shall not be limited to the following working examples.

(Additive)

Additives 1 to 26: The additives 1 to 12 and 19 to 26 as shown in Tables 1 to 11 were prepared by mixing the components (A) and (B) as shown in the tables at predetermined concentrations with compounding molar ratios as indicated therein. Molar ratios between the component (A) and the component (B) for the additives 1 to 8, 10 to 12, 19 to 23, and 26 were 1:1. Molar ratios between the component (A) and the component (B) for the additives 9, 24, and 25 were 2:1.

Additive 13: A reagent produced by Tokyo Chemical Industry Co., Ltd. was used.

Additive 14: PEG-300 (reagent) produced by FUJIFILM Wako Pure Chemical Corporation was used as polyethyleneglycol.

Additive 15: COSMO PURE SPIN C produced by COSMO OIL LUBRICANTS CO., LTD. was used as a paraffinic hydrocarbon (mineral oil).

Additive 16: FLV-181B produced by Miyoshi Oil & Fat CO., LTD. was used as a fatty acid ester.

Additive 17: An ion-exchange water was used.

Additive 18: A reagent produced by Tokyo Chemical Industry Co., Ltd. was used as tetraethylammonium bromide.

The obtained additives and compositions were evaluated as follows. The results are shown in Tables 1 to 11.

1. Lubricity Evaluation of Additives

Lubricities of the additives 1 to 12 in working examples and additives 13 to 17 in comparative examples 13 to 17 were evaluated by measuring their kinetic friction coefficients 1 and 2 and their static friction coefficients using a friction and wear tester (Tribo Gear, Type: 40 by Shinto Scientific Co., Ltd.), and by measuring surface contacts between a cast-iron plate and a plenary stainless steel (50 g of load). Further, the kinetic friction coefficients 2 of the additives 2, 3, 5 to 12, and 19 to 25 of the working examples and the additives 13 to 17 of the comparative examples were measured using a pendulum type oiliness friction tester (by KOBELCO MACHINERY ENGINEERING CO., LTD) (Table 1). The additives 2, 5 to 12, and 19 to 25 were used as hydrates having moisture contents as shown in Table 1. The coagulation points as shown in Table 1 were evaluated by weighing and putting 10 g of the respective additives into 30 mL screw tubes after which they were put into a thermostat of 25° C., −10° C. and then were subjected to evaluation after being left to stand still for 24 hours.

As can be seen from the results shown in Table 1, it was confirmed that the static friction coefficients and the kinetic friction coefficients 1 and 2 of the additives 1 to 12 of the working examples of the present invention were both smaller than those of the additives 13 to 17 of the comparative examples. It was also confirmed that the additives 19 to 25 of the working examples of the present invention had kinetic friction coefficients 2 that were smaller than those of the additives 13 to 17 of the comparative examples, indicating that an additive containing hydrogen-bonding functional group(s) in the component (A) and/or the component (B) had an increased affinity for a material to be abraded with, and thereby exhibited a high lubrication effect.

In comparison among additives 3 to 9 and 19 to 25 sharing the common component (A) and a hydrogen-bonding functional group, the additive additives 3 to 7, 9, and 19 to 25 having a hydrogen-bonding functional group in the component (B) tended to have smaller static friction coefficients and smaller kinetic friction coefficients 1 and 2 than those of the additive 8 having no hydrogen-bonding functional group in the component (B), indicating that a hydrogen-bonding functional group in the component (B) contributed to the lubrication effect. It was also indicated that compounds having a hydrogen-bonding functional group(s) in both of the components (A) and (B) were excellent in lubricity.

The additives 19 and 20 employing sulfur-based anions as a hydrogen-bonding functional group in the component (B) had smaller kinetic friction coefficients 2 compared with and superior, in terms of lubricity, to the additive 21 employing a phosphorus-based anion as a hydrogen-bonding functional group in the component (B). Further, the additives 3 to 7, 9, and 22 to 25 employing a carboxylic acid-based anion as a hydrogen-bonding functional group in the component (B) had smaller kinetic friction coefficients 2 compared with and superior, in terms of lubricity, to the additives 19 to 21 employing a sulfur-based anion or a phosphorus-based anion as a hydrogen-bonding functional group in the component (B). As for the working examples 9, 22 to 25 where the component (B) was a polybasic acid, the working examples 9, 24, and 25 having equivalent compounding ratio between the components (A) and (B) had smaller kinetic friction coefficients 2 compared with and superior, in terms of lubricity, to those of the working examples 22 and 23 where the compounding ratio between the components (A) and (B) was less than equivalent.

Further, the additives 3 and 4 employing an unsaturated aliphatic carboxylic acid, having a long-chain hydrocarbon with the carbon number of 18, had small static friction coefficients and small kinetic friction coefficients 1 and 2, thus exhibiting superior lubricity.

In comparison among the additives 2, 7, 10, 11, and 12 sharing the common component (B) and hydrogen-bonding functional groups, it was indicated that the additives 2, 7, 11, and 12 having hydroxy groups in the component (A) tended to have smaller static friction coefficients and smaller kinetic friction coefficients 1 and 2 compared to those of the additive 10 having no hydroxy group in the component (A). Further, the additive 2 having two hydroxy groups had a smaller static friction coefficient and smaller kinetic friction coefficients 1 and 2 compared to those of the additive 12 having one hydroxy group, and the additives 7 and 11 having three hydroxy groups had smaller static friction coefficients and smaller kinetic friction coefficients 1 and 2 compared to that of the additive 2, indicating that the hydroxy group in the component (A) contributed to the lubricating effect. It was also indicated that a compound having a hydrogen-bonding functional group(s) in both of the components (A) and (B) were excellent in lubricity.

Meanwhile, when compared with the additives having hydroxy group(s), the additives 1 to 12 and 19 to 25 of the working examples were superior in lubricity to the additives 13 and 14 of the comparative examples, indicating that the additives having components (A) and (B) according to the present invention were preferable in terms of lubricity.

Further, when compared with oil-based additives, the additives 1, 3, and 4 of the working examples had smaller coefficients for both types of frictional coefficients than those of the additives 15 and 16 of the comparative examples, indicating that the additives of the present invention having the components (A) and (B) exhibits a high lubrication effect.

TABLE 1A

| | Additive | Component (A): $R_1$ | $R_2$ | $R_3$ | Component (B) | Compounding Molar ratio (A):(B) | Water Content in additive (wt %) | Coagulation point (° C.) | Static friction coefficient | Kinetic friction coefficient 1 | Kinetic friction coefficient 2 |
|---|---|---|---|---|---|---|---|---|---|---|---|
| Working example 1 | 1 | $(CH_2)_2OH$ | $(CH_2)_2OH$ | H | $CH_3(CH_2)_7CH{=}CH(CH_2)_7COOH$ | 1:1 | <1.0 | <−10 | 0.124 | 0.096 | — |
| Working example 2 | 2 | $(CH_2)_2OH$ | $(CH_2)_2OH$ | H | $CH_3CH(OH)COOH$ | 1:1 | 15.6 | <−10 | 0.183 | 0.158 | 0.129 |
| Working example 3 | 3 | $(CH_2)_2OH$ | $(CH_2)_2OH$ | $(CH_2)_2OH$ | $CH_3(CH_2)_7CH{=}CH(CH_2)_7COOH$ | 1:1 | <1.0 | <−10 | 0.110 | 0.089 | 0.094 |
| Working example 4 | 4 | $(CH_2)_2OH$ | $(CH_2)_2OH$ | $(CH_2)_2OH$ | $CH_3(CH_2)_4CH{=}CHCH_2CH{=}CH(CH_2)_7COOH$ | 1:1 | <1.0 | <−10 | 0.130 | 0.100 | — |
| Working example 5 | 5 | $(CH_2)_2OH$ | $(CH_2)_2OH$ | $(CH_2)_2OH$ | Ph—CH(OH)COOH | 1:1 | 15.2 | <−10 | 0.160 | 0.137 | 0.118 |
| Working example 6 | 6 | $(CH_2)_2OH$ | $(CH_2)_2OH$ | $(CH_2)_2OH$ | $CH_3$—O—$CH_2COOH$ | 1:1 | 18.4 | <−10 | 0.149 | 0.113 | 0.103 |
| Working example 7 | 7 | $(CH_2)_2OH$ | $(CH_2)_2OH$ | $(CH_2)_2OH$ | $CH_3CH(OH)COOH$ | 1:1 | 19.2 | <−10 | 0.180 | 0.153 | 0.120 |
| Working example 79 | 19 | $(CH_2)_2OH$ | $(CH_2)_2OH$ | $(CH_2)_2OH$ | $CH_3SO_3H$ | 1:1 | 18.1 | <−10 | — | — | 0.145 |
| Working example 80 | 20 | $(CH_2)_2OH$ | $(CH_2)_2OH$ | $(CH_2)_2OH$ | $CH_3$—Ph—$SO_3H$ | 1:1 | 14.4 | <−10 | — | — | 0.145 |
| Working example 81 | 21 | $(CH_2)_2OH$ | $(CH_2)_2OH$ | $(CH_2)_2OH$ | $H_3PO_2$ | 1:1 | 14.3 | <−10 | — | — | 0.147 |
| Working example 8 | 8 | $(CH_2)_2OH$ | $(CH_2)_2OH$ | $(CH_2)_2OH$ | $HBF_4$ | 1:1 | 18.6 | <−10 | 0.190 | 0.165 | 0.155 |
| Working example 82 | 22 | $(CH_2)_2OH$ | $(CH_2)_2OH$ | $(CH_2)_2OH$ | HOOC—CH(CH)$CH_2$—COOH | 1:1 | 11.3 | <−10 | — | — | 0.135 |
| Working example 83 | 23 | $(CH_2)_2OH$ | $(CH_2)_2OH$ | $(CH_2)_2OH$ | HOOC—$CH_2CH_2$—COOH | 1:1 | 11.9 | <−10 | — | — | 0.140 |
| Working example 9 | 9 | $(CH_2)_2OH$ | $(CH_2)_2OH$ | $(CH_2)_2OH$ | HOOC—CH(OH)$CH_2$—COOH | 2:1 | 7.7 | <−10 | 0.140 | 0.120 | 0.109 |
| Working example 84 | 24 | $(CH_2)_2OH$ | $(CH_2)_2OH$ | $(CH_2)_2OH$ | HOOC—CH(OH)CH(OH)—COOH | 2:1 | 7.4 | <−10 | — | — | 0.110 |
| Working example 85 | 25 | $(CH_2)_2OH$ | $(CH_2)_2OH$ | $(CH_2)_2OH$ | HOOC—$CH_2CH_3$ COOH | 2:1 | 8.0 | <−10 | — | — | 0.130 |
| Working example 10 | 10 | $CH_3CH_2$ | $CH_3CH_2$ | $CH_3CH_2$ | $CH_3CH(OH)COOH$ | 1:1 | 15.9 | <−10 | 0.200 | 0.166 | 0.158 |
| Working example 11 | 11 | $CH_2OH$<br>—C—$CH_2OH$<br>$CH_2OH$ | H | H | $CH_3CH(OH)COOH$ | 1:1 | 14.6 | <−10 | 0.177 | 0.153 | 0.119 |

TABLE 1A-continued

| | Additive | Component (A): $R_1$ | $R_2$ | $R_3$ | Component (B) | Compounding Molar ratio (A):(B) | Water Content in additive (wt %) | Coagulation point (° C.) | Static friction coefficient | Kinetic friction coefficient 1 | Kinetic friction coefficient 2 |
|---|---|---|---|---|---|---|---|---|---|---|---|
| Working example 12 | 12 | $-C(CH_2OH)(CH_3)_2$ | H | H | $CH_3CH(OH)COOH$ | 1:1 | 16.7 | <−10 | 0.185 | 0.162 | 0.145 |
| Comparative example 1 | 13 | | | | 1,2,4-butanetriol | | <1.0 | <−10 | 0.202 | 0.201 | 0.210 |
| Comparative example 2 | 14 | | | | polyethyleneglycol | | <1.0 | <−10 | 0.208 | 0.178 | 0.193 |
| Comparative example 3 | 15 | | | | paraffinic hydrocarbon | | <1.0 | <−10 | 0.222 | 0.179 | 0.179 |
| Comparative example 4 | 16 | | | | fatty acid ester | | <1.0 | <−10 | 0.205 | 0.169 | 0.160 |
| Comparative example 5 | 17 | | | | ion-exchange water | | — | 0 | 0.286 | 0.210 | 0.208 |

2. Lubricity Evaluation of Aqueous Lubrication Compositions

The static friction coefficient and kinetic friction coefficients 1 and 2 were measured by the same method as explained in the section of "1." with respect to 50 wt. % aqueous solutions of the additives 1 to 12 according to the working examples, 70 wt. % aqueous solution of the additive 7 according to the working example, 50 wt. % aqueous solutions of the additives 13, 14, and 18 according to the comparative examples, 70 wt. % aqueous solution of the additive 14 according to the comparative example, and additive 17 according to the comparative example (Table 2). Further, kinetic friction coefficients 2 of 50 wt. % aqueous solutions of the additives 19 to 26 according to the working examples were measured by a similar method as explained in the section of "1." (Table 2). The coagulation points as shown in Table 2 were evaluated such that the respective additives were put into a thermostat of 25° C. and −10° C. after which they were left to stand still for 24 hours for evaluation.

As can be seen from the results shown in Table 2, it was confirmed that both the static friction coefficients and kinetic friction coefficients 1 and 2 of 50 wt. % aqueous solutions of the additives 1 to 12 according to the present invention were smaller than those of 50 wt. % aqueous solutions of the additives 13, 14, and 18 of the comparative examples and those of the additive 17, which indicates that they were also excellent in lubricity as aqueous lubrication compositions. Further, 70 wt % aqueous solution of the additive 7 had a smaller kinetic friction coefficient 2 compared to that of 70 wt % aqueous solution of the additive 14 according to the comparative example, which indicates that it was also excellent in lubricity as an aqueous lubrication composition. Further, 50 wt % aqueous solutions of the additives 19 to 26 of the working examples according to the present invention had smaller kinetic friction coefficients 2 compared to those of 50 wt % aqueous solutions of the additives 13, 14, and 18 according to the comparative examples and that of the additive 17, indicating that they were also excellent in lubricity as aqueous lubrication compositions.

Further, as for the aqueous lubrication compositions, the correlations between structures and lubricities of the components (A) and (B) were shown to have similar tendencies as those shown in "1. Evaluation of additives" as mentioned above.

In addition, in view of structural similarity, as the additives 1 to 12 and 19 to 26 of the working examples having a hydrogen-bonding functional group in the component (A) or (B) were superior in lubricity to the additive 18 of the comparative example, it was indicated that a hydrogen-bonding functional group contributed to the lubricity.

Further, 50 wt % aqueous solutions of the additives 13 and 14 of comparative examples had substantially the same kinetic friction coefficients 1 and 2 as those of the system of the comparative example 10 consisting only of ion-exchange water and no lubrication effect was expressed thereon, while the additives of the working examples showed reduced kinetic friction coefficients 1 and 2, which indicates that they had excellent kinetic friction coefficients 1 and 2 also as aqueous lubrication compositions.

It was also confirmed that while the compositions of working examples 13, 15, and 16 foamed, the compositions of working examples 14, 17 to 25, and 86 to 93 showed no foaming and were thus indicated to be industrially highly useful.

The components (A) and (B) were mixed at predetermined concentrations as shown in Table 2, and water was removed from each of the obtained additives to conduct NMR testing using heavy water. It was confirmed that the components (A) and (B) formed a structure of an ammonium salt.

Water was added to them to make 50 and 70 wt % solutions whose static and kinetic friction coefficients 1 and 2 were measured. The results show that they exhibited static and kinetic frictional coefficients 1 and 2 comparative to and having a tendency similar to the additive aqueous solutions of working examples 13 to 25 and 86 to 93 in Table 2. This result shows that a mixture and an ammonium salt of the components (A) and (B) have similar lubricating capabilities.

TABLE 2A

| | Additive | Component (A): $R_1$ | $R_2$ | $R_3$ | Component (B) | Compounding Molar ratio (A):(B) | Water content in additive (wt %) | Coagulation point (° C.) | Static friction coefficient | Kinetic friction coefficient 1 | Kinetic friction coefficient 2 |
|---|---|---|---|---|---|---|---|---|---|---|---|
| Working example 13 | 1 | $(CH_2)_2OH$ | $(CH_2)_2OH$ | H | $CH_3(CH_2)_2CH{=}CH(CH_2)_7COOH$ | 1:1 | 50.0 | <−10 | 0.160 | 0.159 | — |
| Working example 14 | 2 | $(CH_2)_2OH$ | $(CH_2)_2OH$ | H | $CH_3CH(OH)COOH$ | 1:1 | 50.0 | <−10 | 0.218 | 0.198 | 0.158 |
| Working example 15 | 3 | $(CH_2)_2OH$ | $(CH_2)_2OH$ | $(CH_2)_2OH$ | $CH_3(CH_2)_2CH{=}CH(CH_2)_7COOH$ | 1:1 | 50.0 | <−10 | 0.154 | 0.146 | 0.109 |
| Working example 16 | 4 | $(CH_2)_2OH$ | $(CH_2)_2OH$ | $(CH_2)_2OH$ | $CH_3(CH_2)_4CH{=}CHCH_2CH{=}CH(CH_2)_7COOH$ | 1:1 | 50.0 | <−10 | 0.168 | 0.145 | — |
| Working example 17 | 5 | $(CH_2)_2OH$ | $(CH_2)_2OH$ | $(CH_2)_2OH$ | Ph—CH(OH)COOH | 1:1 | 50.0 | <−10 | 0.220 | 0.167 | 0.138 |
| Working example 18 | 6 | $(CH_2)_2OH$ | $(CH_2)_2OH$ | $(CH_2)_2OH$ | $CH_3$—O—$CH_2COOH$ | 1:1 | 50.0 | <−10 | 0.179 | 0.163 | 0.124 |
| Working example 19 | 7 | $(CH_2)_2OH$ | $(CH_2)_2OH$ | $(CH_2)_2OH$ | $CH_3CH(OH)COOH$ | 1:1 | 50.0 | <−10 | 0.217 | 0.193 | 0.142 |
| Working example 20 | 7 | $(CH_2)_2OH$ | $(CH_2)_2OH$ | $(CH_2)_2OH$ | $CH_3CH(OH)COOH$ | 1:1 | 70.0 | <−10 | — | — | 0.129 |
| Working example 86 | 19 | $(CH_2)_2OH$ | $(CH_2)_2OH$ | $(CH_2)_2OH$ | $CH_2SO_3H$ | 1:1 | 50.0 | <−10 | — | — | 0.158 |
| Working example 87 | 20 | $(CH_2)_2OH$ | $(CH_2)_2OH$ | (CH)2OH | $CH_3$—Ph—$SO_3H$ | 1:1 | 50.0 | <−10 | — | — | 0.157 |
| Working example 88 | 21 | $(CH_2)_2OH$ | $(CH_2)_2OH$ | $(CH_2)_2OH$ | $H_3PO_2$ | 1:1 | 50.0 | <−10 | — | — | 0.160 |
| Working example 89 | 26 | $(CH_2)_2OH$ | $(CH_2)_2OH$ | $(CH_2)_2OH$ | $H_3PO_4$ | 1:1 | 50.0 | <−10 | — | — | 0.171 |
| Working example 21 | 8 | $(CH_2)_2OH$ | $(CH_2)_2OH$ | $(CH_2)_2OH$ | $HBF_4$ | 1:1 | 50.0 | <−10 | 0.222 | 0.204 | 0.183 |
| Working example 90 | 22 | $(CH_2)_2OH$ | $(CH_2)_2OH$ | $(CH_2)_2OH$ | HOOC—CH(OH)$C_2$—COOH | 1.1 | 50.0 | <−10 | — | — | 0.150 |
| Working example 91 | 23 | $(CH_2)_2OH$ | $(CH_2)_2OH$ | $(CH_2)_2OH$ | HOOC—$CH_2CH_2$—COOH | 1:1 | 50.0 | <−10 | — | — | 0.155 |
| Working example 22 | 9 | $(CH_2)_2OH$ | $(CH_2)_2OH$ | $(CH_2)_2OH$ | HOOC—CH(OH)$CH_2$—COOH | 2:1 | 50.0 | <−10 | 0.185 | 0.170 | 0.135 |
| Working example 92 | 24 | $(CH_2)_2OH$ | $(CH_2)_2OH$ | $(CH_2)_2OH$ | HOOC—CH(OH)CH(OH)—COOH | 2:1 | 50.0 | <−10 | — | — | 0.135 |
| Working example 93 | 25 | $(CH_2)_2OH$ | $(CH_2)_2O)H$ | $(CH_2)_2OH$ | HOO—$CH_2CH_2$—COOH | 2:1 | 50.0 | <−10 | — | — | 0.145 |
| Working example 23 | 10 | $CH_3CH_2$ | $CH_3CH_2$ | $CH_3CH_2$ | $CH_2CH(OH)OCOOH$ | 1:1 | 50.0 | <−10 | 0.224 | 0.205 | 0.201 |

TABLE 2A-continued

| | Additive | Component (A): $R_1$ | $R_2$ | $R_3$ | Component (B) | Compounding Molar ratio (A):(B) | Water content in additive (wt %) | Coagulation point (° C.) | Static friction coefficient | Kinetic friction coefficient 1 | Kinetic friction coefficient 2 |
|---|---|---|---|---|---|---|---|---|---|---|---|
| Working example 24 | 11 | $CH_2OH$ \| —C—$CH_2OH$ \| $CH_2OH$ | H | H | $CH_2CH(OH)COOH$ | 1:1 | 50.0 | <−10 | 0.215 | 0.185 | 0.140 |
| Working example 25 | 12 | $CH_2OH$ \| —C—$CH_3$ \| $CH_3$ | H | H | $CH_2CH(OH)COOH$ | 1:1 | 50.0 | <−10 | 0.220 | 0.200 | 0.170 |
| Comparative example 6 | 18 | | | | Tetraethylammonium bromide | — | 50.0 | <−10 | 0.226 | 0.208 | 0.204 |
| Comparative example 7 | 13 | | | | 1,2,4-butanetriol | — | 50.0 | <−10 | 0.232 | 0.211 | 0.215 |
| Comparative example 8 | 14 | | | | Polyethyleneglycol | — | 50.0 | <−10 | 0.228 | 0.210 | 0.207 |
| Comparative example 9 | 14 | | | | Polyethyleneglycol | — | 70.0 | <−10 | — | — | 0.198 |
| Comparative example 10 | 17 | | | | Ion-exchange water | — | — | 0 | 0.286 | 0.210 | 0.208 |

3. Lubricity Evaluation of Lubrication Compositions Containing Surfactants

Here, 5 g of additive 3 and 0.5 g of diglyceryl monooleate (surfactant) were weighed and heated at 70° C. to which 4.5 g of water was then added and mixed at 2,000 rpm for 1 minute five times using a planetary centrifugal mixer (THINKY INC., ARE-310) to make an emulsion lubrication composition having compounding contents of 50 wt % of additive 3 of working example 27 and 5 wt % of surfactant. This emulsion was confirmed to have remained unseparated even after 7 days. Similarly, a lubrication composition having compounding contents of 50 wt % of additive 3 and 2.5 wt % or 0.5 wt % of surfactant was made, which was then confirmed to have maintained an emulsion state for 7 days.

Further, a lubrication composition having compounding contents of 80 wt % of additive 3 and 5 wt % or 0.5 wt % of surfactant was made in a similar way, which was then confirmed to have maintained an emulsion state for 7 days. As can be seen from these results, they can be applied to water-soluble cutting oil agents of the types classified by JIS as class A1: emulsion type (having a lubricant content of 80 wt % or more), class A2: soluble (having a lubricant content of 60 to 95 wt %), and class A3: solution (having a lubricant content of 20 to 60 wt %).

The static friction coefficients and kinetic friction coefficients 1 and 2 of these working examples 26 and 27 were measured by a similar method as explained in the section of "1. Lubricity evaluation" (Table 3). The working example 26 used 50 wt % aqueous solution of the additive 3.

The static friction coefficients and kinetic friction coefficients 1 and 2 of the working examples 26 and 27 were smaller than those of the comparative examples 11 to 13. Further, the working example 27 containing surfactant had lubrication capability that is superior to that of the working example 26.

TABLE 3

| | Additive | Component (A): $R_1$ | $R_2$ | $R_3$ | Component (B) | Compounding molar ratio (A):(B) | Addition of surfactant | Additive concentration in aqueous solution (wt %) | Coagulation point (° C.) | Static friction coefficient | Kinetic friction coefficient 1 | Kinetic friction coefficient 2 |
|---|---|---|---|---|---|---|---|---|---|---|---|---|
| Working example 26 | 3 | $(CH_2)_2OH$ | $(CH_2)_2OH$ | $(CH_2)_2OH$ | $CH_2(CH_2)_7CH{=}CH(CH_2)_7COOH$ | 1:1 | w/o | 50.0 | <−10 | 0.154 | 0.146 | 0.109 |
| Working example 27 | 3 | | | | | 1.1 | w/ | 50.0 | <−10 | 0.100 | 0.070 | 0.098 |
| Comparative example 11 | 13 | | | 1,2,4-butanetriol | | — | w/o | 50.0 | <−10 | 0.232 | 0.211 | — |
| Comparative example 12 | 14 | | | Polyethyleneglycol | | — | w/o | 50.0 | <−10 | 0.228 | 0.210 | 0.207 |
| Comparative example 13 | 17 | | | Ion-exchange water | | — | — | — | 0 | 0.286 | 0.210 | 0.208 |

4. Lubricity Evaluation on Lubrication Compositions Used as Additives

The static friction coefficients and kinetic friction coefficients 1 of the additives 14 and 17 and those of the lubrication composition of the working example 28 containing 1 wt % of additive 3 per 100 wt % of an existing lubricant 14 were measured by a similar method as explained in the section of "1. Lubricity evaluation" (Table 4).

The lubrication composition of the working example 28 according to the present invention had a smaller static friction coefficient and a smaller kinetic friction coefficient 1 compared to those of the comparative examples 14 and 15, which shows that it contributed to the enhancement in lubrication property as, for example, an additive for lubricants.

TABLE 4

| | Additive | Coagulation point (° C.) | Static friction coefficient | Kinetic friction coefficient 1 |
|---|---|---|---|---|
| Working example 28 | Additive 14 (Polyethyleneglycol) + Additive 3 (1% added) | <−10 | 0.203 | 0.166 |
| Comparative example 14 | Additive 14 (Polyethyleneglycol) | <−10 | 0.208 | 0.178 |

TABLE 4-continued

| | Additive | Coagulation point (° C.) | Static friction coefficient | Kinetic friction coefficient 1 |
|---|---|---|---|---|
| Comparative example 15 | Additive 17 (Ion-exchange water) | 0 | 0.286 | 0.210 |

5. Metal Corrosion Evaluation of Additive

Corrosiveness was evaluated based on a testing method as set forth in JIS K2241 (cutting oil agent). SPCC steel plate (10 mm×10 mm×1 mm) as set forth in JIS G 3141, C1100P copperplate (10 mm×10 mm×1 mm) as set forth in JIS H 3100, A1050P aluminum plate (10 mm×10 mm×1 mm) as set forth in JIS H 4000 are respectively placed in 10 mL test tubes, and 3 g of additives 1 to 12 were added to the respective test tubes in which the metal pieces were immersed, and they were left for 48 hours at room temperature (25° C.). The metal strips were then washed by the method as set forth in JIS to evaluate the presence or absence of discoloration on the metal pieces by visually comparing them with the respective untreated metal strips. The additives 2 and 5 to 12 as used were of hydrate with water contents as shown in table 5, while the additives 1, 3, and 4 as used had water contents as shown in table 5.

As can be seen from the results in table 5, it was confirmed that the additives 1 to 12 of the working examples caused no discoloration on all of the metal strips of steel, copper, and aluminum, which shows that they exhibited no metal corrosiveness.

TABLE 5

| | Additive | Component (A): $R_1$ | $R_2$ | $R_3$ | Component (B) | Compounding raio (A):(B) | Addition of surfactant | Water content in additive (wt %) | Metal corrosiveness: Steel | Copper | Aluminum |
|---|---|---|---|---|---|---|---|---|---|---|---|
| Working example 29 | 1 | $(CH_2)_2OH$ | $(CH_2)_2OH$ | H | $CH_3(CH_2)_7CH{=}CH(CH_2)_7COOH$ | 1.1 | w/o | <1.0 | Discoloration not observed | Discoloration not observed | Discoloration not observed |
| Working example 30 | 2 | $(CH_2)_2OH$ | $(CH_2)_2OH$ | H | $CH_2CH(OH)COOH$ | 1:1 | w/o | 15.6 | Discoloration not observed | Discoloration not observed | Discoloration not observed |
| Working example 31 | 3 | $(CH_2)_2OH$ | $(CH_2)_2OH$ | $(CH_2)_2OH$ | $CH_2(CH_2)_7CH{=}CH(CH_2)_7COOH$ | 1:1 | w/o | <1.0 | Discoloration not observed | Discoloration not observed | Discoloration not observed |
| Working example 32 | 4 | $(CH_2)_2OH$ | $CH_2)_2OH$ | $(CH_2)_2OH$ | $CH_3(CH_2)_7CH{=}CHCH_2CH{=}CH(CH_2)_7COOH$ | 1:1 | w/o | <1.0 | Discoloration not observed | Discoloration not observed | Discoloration not observed |
| Working example 33 | 5 | $(CH_2)_2OH$ | $(CH_2)_2OH$ | $(CH_2)_2OH$ | Ph—CH(OH)COOH | 1:1 | w/o | 15.2 | Discoloration not observed | Discoloration not observed | Discoloration not observed |
| Working example 34 | 6 | $(CH_2)_2OH$ | $(CH_2)_2OH$ | $(CH_2)OH$ | $CH_2$—O—$CH_2COOH$ | 1:1 | w/o | 18.4 | Discoloration not observed | Discoloration not observed | Discoloration not observed |
| Working example 35 | 7 | $(CH_2)_2OH$ | $(CH_2)_2OH$ | $(CH_2)_2$ OH | $CH_2CH(OH)COOH$ | 1:1 | w/o | 19.2 | Discoloration not observed | Discoloration not observed | Discoloration not observed |
| Working example 36 | 8 | $(CH_2)_2OH$ | $(CH_2)_2OH$ | $(CH_2)_2OH$ | $HBF_4$ | 1:1 | w/o | 18.6 | Discoloration not observed | Discoloration not observed | Discoloration not observed |
| Working example 37 | 9 | $(CH_2)_2OH$ | $(CH_2)_2OH$ | $(CH_2)_2OH$ | HOOC—CH(OH)$CH_2$—COOH | 2:1 | w/o | 7.7 | Discoloration not observed | Discoloration not observed | Discoloration not observed |
| Working example 38 | 10 | $CH_3CH_2$ | $CH_3CH_2$ | $CH_3CH_2$ | $CH_3CH(OH)COOH$ | 1:1 | w/o | 15.9 | Discoloration not observed | Discoloration not observed | Discoloration not observed |
| Workig example 39 | 11 | $CH_2OH$ | H | H | $CH_3CH(OH)COOH$ | 1:1 | w/o | 14.6 | Discoloration not observed | Discoloration not observed | Discoloration not observed |

TABLE 5-continued

| | Additive | Component (A): $R_1$ | $R_2$ | $R_3$ | Component (B) | Compounding raio (A):(B) | Addition of surfactant | Water content in additive (wt %) | Metal corrosiveness: Steel | Copper | Aluminum |
|---|---|---|---|---|---|---|---|---|---|---|---|
| Working example 40 | 12 | $-C(CH_2OH)(CH_3)_2$ | H | H | $CH_3CH(OH)COOH$ | 1:1 | w/o | 16.7 | Discoloration not observed | Discoloration not observed | Discoloration not observed |
| Working example 41 | 3 | $(CH_2)_2OH$ | $(CH_2)_2OH$ | $(CH_2)_2OH$ | $CH_3(CH_2)_7CH{=}CH(CH_2)_2COOH$ | 1:1 | w/ | 45.0 | Discoloration not observed | Discoloration not observed | Discoloration not observed |

6. Low-Temperature Fluidity Evaluation of Aqueous Lubrication Composition

Here, 50 wt % aqueous solutions of additives 2, 5 to 12, and 19 to 25 (working examples 42 to 50, and 94 to 100), 50 wt % of the additive 3 in emulsion prepared in a manner similar to the working example 27 shown above (working example 51), and 50 wt % aqueous solutions of additive 14 (comparative example 16) were each taken by an amount of 10 g and put into 30 mL screw tubes after which they were left in a thermostat at −10° C. to stand still for 24 hours to check the fluidities (pour points) of the respective samples (Table 6).

The samples of the working examples did not coagulate at −10° C. and retained their fluidity while the comparative example exhibited no fluidity at −10° C., indicating that the additives of the present invention exhibited pour point depressing capability, and that the aqueous lubrication compositions were excellent in low-temperature stability.

7. Thermal Conductivity Evaluation of Additives.

Thermal conductivities were evaluated for 50 wt % aqueous solutions of additives 3, 4, 7, 9, and 11 (working examples 52 to 56), 50 wt % of the additive 3 in emulsion (working example 57) prepared in a manner similar to the working example 27 shown above, and 50 wt % aqueous solutions of additives 13, 14, 17 and 18 (comparative examples 17 to 20). Each of the samples was added into a 50 mL screw tube, provided with a thermostat, and then left on a hot plate (PC-35 manufactured by IWAKI) to stand still. The heater level was set to 1, and the liquid temperature of each sample was measured before heating and after 1, 3, 5, 10, and 15 minutes of heating (Table 7).

The liquid temperatures of the working examples were higher than those of the comparative examples at all heating times of 1 to 15 minutes, showing that the additives of the present invention had excellent thermal conductivities (high cooling efficiency).

TABLE 6

| | Additive | Component (A): $R_1$ | $R_2$ | $R_3$ | Component (B) | Compounding molar ratio (A):(B) | Addition of surfactant | Flow point (° C.) |
|---|---|---|---|---|---|---|---|---|
| Working example 42 | 2 | $(CH_2)_2OH$ | $(CH_2)_2OH$ | H | $CH_2CH(OH)COOH$ | 1:1 | w/o | <−10 |
| Working example 43 | 5 | $(CH_2)_2OH$ | $(CH_2)_2OH$ | $(CH_2)_2OH$ | Ph—CH(OH)COOH | 1:1 | w/o | <−10 |
| Working example 44 | 6 | $(CH_2)_2OH$ | $(CH_2)_2OH$ | $(CH_2)_2OH$ | $CH_2O—CH_2COOH$ | 1:1 | w/o | <−10 |
| Working example 45 | 7 | $(CH_2)_2OH$ | $(CH_2)_2OH$ | $(CH_2)_2OH$ | $CH_2CH(OH)COOH$ | 1:1 | w/o | <−10 |
| Working example 94 | 19 | $(CH_2)_2OH$ | $(CH_2)_2OH$ | $(CH_2)_2OH$ | $CH_3SO_3H$ | 1:1 | w/o | <−10 |
| Working example 95 | 20 | $(CH_2)_2OH$ | $(CH_2)_2OH$ | $(CH_2)_2OH$ | $CH_2—Ph—SO_3H$ | 1:1 | w/o | <−10 |
| Working example 96 | 21 | $(CH_2)_2OH$ | $(CH_2)_2OH$ | $(CH_2)_2OH$ | $H_3PO_2$ | 1:1 | w/o | <−10 |
| Working example 46 | 8 | $(CH_2)_2OH$ | $(CH_2)_2OH$ | $(CH_2)_2OH$ | $HBF_4$ | 1:1 | w/o | <−10 |
| Working example 97 | 22 | $(CH_2)_2OH$ | $(CH_2)_2OH$ | $(CH_2)_2OH$ | $HOOC—CH(OH)CH_2—COOH$ | 1:1 | w/o | <−10 |
| Working example 98 | 23 | $(CH_2)_2OH$ | $(CH_2)_2OH$ | $(CH_2)_2OH$ | $HOOC—CH_2CH_2—COOH$ | 1:1 | w/o | <−10 |
| Working example 47 | 9 | $(CH_2)_2OH$ | $(CH_2)_2OH$ | $(CH_2)_2OH$ | HOOC—CH(OH)CH—COOH | 2:1 | w/o | <−10 |
| Working example 99 | 24 | $(CH_2)_2OH$ | $(CH_2)_2OH$ | $(CH_2)_2OH$ | HOOC—CH(OH)CH(OH)—COOH | 2:1 | w/o | <−10 |
| Working example 100 | 25 | $(CH_2)_2OH$ | $(CH_2)_2OH$ | $(CH_2)_2OH$ | $HOOC—CH_2CH_2—COOH$ | 2:1 | w/o | <−10 |
| Working example 48 | 10 | $CH_3CH_2$ | $CH_3CH_2$ | $CH_3CH_2$ | $CH_2CH(OH)COOH$ | 1:1 | w/o | <−10 |
| Working example 49 | 11 | $—C(CH_2OH)_3$ | H | H | $CH_2CH(OH)COOH$ | 1:1 | w/o | <−10 |
| Working example 50 | 12 | $—C(CH_2OH)_2CH_3$ | H | H | $CH_2CH(OH)COOH$ | 1:1 | w/o | <−10 |
| Working example 51 | 3 | $(CH_2)_2OH$ | $(CH_2)_2OH$ | $(CH_2)_2OH$ | $CH_2(CH_2)_7CH=CH(CH_2)_7COOH$ | 1:1 | w/ | <−10 |
| Comparative example 16 | 14 | Polyethyleneglycol | | | | — | w/o | >−10 |

TABLE 7

| | Additive | Component (A): $R_1$ | $R_2$ | $R_3$ | Component (B) |
|---|---|---|---|---|---|
| Working example 52 | 3 | $(CH_2)_2OH$ | $(CH_2)_2OH$ | $(CH_2)_2OH$ | $CH_3(CH_2)_7CH{=}CH(CH_2)_7COOH$ |
| Working example 53 | 4 | $(CH_2)_2OH$ | $(CH_2)_2OH$ | $(CH_2)_2OH$ | $CH_2(CH_2)_4CH{=}CHCH_2CH{=}CH(CH_2)_7COOH$ |
| Working example 54 | 7 | $CH_2)_2OH$ | $(CH_2)_2OH$ | $(CH_2)_2OH$ | $CH_2CH(OH)COOH$ |
| Working example 55 | 9 | $(CH_2)_2OH$ | $(CH_2)_2OH$ | $(CH_2)_2OH$ | $HOOC{-}CH(OH)CH_2{-}COOH$ |
| Working example 56 | 11 | $CH_2OH$<br>\|<br>$-C-CH_2OH$<br>\|<br>$CH_2OH$ | H | H | $CH_3CH(OH)COOH$ |
| Working example 57 | 3 | $(CH_2)_2OH$ | $(CH_2)_2OH$ | $(CH_2)_2OH$ | $CH_3(CH_2)_7CH{=}CH(CH_2)_7COOH$ |
| Comparative example 17 | 18 | Tetraethylammonium bromide | | | |
| Comparative example 18 | 13 | 1,2,4-butanetriol | | | |
| Comparative example 19 | 14 | Polyethyleneglycol | | | |
| Comparative example 20 | 17 | Ion-exchange water | | | |

| | Compounding molar ratio (A):(B) | Addition of surfactant | Liquid temperature (° C.) 0 min | 1 min | 3 min | 5 min | 10 min | 15 min |
|---|---|---|---|---|---|---|---|---|
| Working example 52 | 1:1 | w/o | 27 | 30 | 35 | 41 | 51 | 65 |
| Working example 53 | 1:1 | w/o | 27 | 30 | 35 | 40 | 52 | 65 |
| Working example 54 | 1:1 | w/o | 27 | 32 | 38 | 44 | 59 | 73 |
| Working example 55 | 2:1 | w/o | 27 | 32 | 39 | 45 | 60 | 75 |
| Working example 56 | 1:1 | w/o | 27 | 33 | 40 | 48 | 60 | 75 |
| Working example 57 | 1:1 | w/ | 27 | 30 | 38 | 43 | 55 | 68 |
| Comparative example 17 | — | w/o | 27 | 28 | 30 | 35 | 44 | 53 |
| Comparative example 18 | — | w/o | 27 | 29 | 30 | 36 | 44 | 59 |
| Comparative example 19 | — | w/o | 27 | 28 | 29 | 35 | 42 | 55 |
| Comparative example 20 | — | w/o | 27 | 28 | 30 | 34 | 46 | 58 |

8. Thermal Stability Evaluation of Additives

The tests were carried out with reference to a testing method as set forth in "Petroleum products-Lubricating oils-Determination of thermal stability (JISK 2540)". To 30 mL test tubes, there were respectively added 20 g of additives 1 to 12 of working examples (working examples 58 to 69) and 20 g of 50 wt % of additive 3 in emulsion prepared in a manner similar to the working example 27 shown above (working example 70), which were then left to stand still in a thermostatic bath of 170° C. for 12 hours. The presence or absence of precipitate was visually confirmed to evaluate their thermal stabilities (Table 8). The additives 2 and 5 to 12 as used were of hydrate with water contents as shown in table 8, while the additives 1, 3, and 4 as used had water contents as shown in table 8.

No precipitations were found for all of the additives of the working examples after the heat application (no separations were found for emulsions), which shows that they were excellent in thermal stability.

TABLE 8

| | Additive | Component (A): $R_1$ | $R_2$ | $R_3$ | Component (B) | Compounding molar ratio (A):(B) | Addition of surfactant | Water content in additive (wt %) | Presence or absence of precipitate |
|---|---|---|---|---|---|---|---|---|---|
| Working example 58 | 1 | $(CH_2)_2OH$ | $(CH_2)_2OH$ | H | $CH_3(CH_2)_7CH{=}CH(CH_2)_7COOH$ | 1:1 | w/o | <1.0 | not observed |
| Working example 59 | 2 | $(CH_2)_2OH$ | $(CH_2)_2OH$ | H | $CH_2CH(OH)COOH$ | 1:1 | w/o | 15.6 | not observed |
| Working example 60 | 3 | $(CH_2)_2OH$ | $(CH_2)_2OH$ | $(CH_2)_2OH$ | $CH_2(CH_2)_7CH{=}CH(CH_2)_7COOH$ | 1:1 | w/o | <1.0 | not observed |
| Working example 61 | 4 | $(CH_2)_2OH$ | $(CH_2)_2OH$ | $(CH_2)_2OH$ | $CH_3(CH_2)_4CH{=}CHCH_2CH{=}CH(CH_2)_7COOH$ | 1:1 | w/o | <1.0 | not observed |
| Working example 62 | 5 | $(CH_2)_2OH$ | $(CH_2O_2OH$ | $(CH_2)_2OH$ | Ph—CH(OH)COOH | 1:1 | w/o | 15.2 | not observed |
| Working example 63 | 6 | $(CH_2)_2OH$ | $(CH_2)_2OH$ | $(CH_2)_2OH$ | $CH_3$—O—$CH_2COOH$ | 1:1 | w/o | 18.4 | not observed |
| Working example 64 | 7 | $(CH_2)_2OH$ | $(CH_2)_2OH$ | $(CH_2)_2OH$ | $CH_3CH(OH)COOH$ | 1:1 | w/o | 19.2 | not observed |
| Working example 65 | 8 | $(CH_2)_2OH$ | $(CH_2)_2OH$ | $(CH_2)_2OH$ | $HBF_4$ | 1:1 | w/o | 18.6 | not observed |
| Working example 66 | 9 | $(CH_2)_2OH$ | $(CH_2)_2OH$ | $(CH_2)_2OH$ | HOOC—CH(OH)$CH_2$—COOH | 2:1 | w/o | 7.7 | not observed |
| Working example 67 | 10 | $CH_3CH_2$ | $CH_3CH_2$ | $CH_3CH_2$ | $CH_3CH(OH)COOH$ | 1:1 | w/o | 15.9 | not observed |
| Working example 68 | 11 | $CH_2OH$<br>—C—$CH_2OH$<br>$CH_2OH$ | H | H | $CH_3CH(OH)COOH$ | 1:1 | w/o | 14.6 | not observed |
| Working example 69 | 12 | $CH_2OH$<br>—C—$CH_3$<br>$CH_3$ | H | H | $CH_3CH(OH)COOH$ | 1:1 | w/o | 16.7 | not observed |
| Working example 70 | 3 | $(CH_2)_2OH$ | $(CH_2)_2OH$ | $(CH_2)_2OH$ | $CH_3(CH_2)_7CH{=}CH(CH_2)_7COOH$ | 1:1 | w/ | 45.0 | not observed |

9. Oxidation Stability Evaluation of Additives

The tests were carried out with reference to a testing method as set forth in "Lubricating oils-Determination of oxidation stability (JISK 2514)". To 30 mL test tubes there were respectively added 20 g of additives 3, 4, 7, 9, and 11 (working examples 71 to 75), 20 g of 50 wt % of additive 3 in emulsion prepared in a manner similar to the working example 27 shown above (working example 76) and 20 g of additive 14 (comparative example 21) into which SPCC steel plate (10 mm×10 mm×1 mm) as set forth in JIS G 3141 and C1100P copper plate (10 mm×10 mm×1 mm) as set forth in JIS H 3100 were put and then left to stand still in a thermostatic bath of 165° C. for 24 hours. The total acid numbers of the samples before and after heating were measured to calculate the Δ total acid number ("Total acid number after heating"−"Total acid number before heating") (Table 9). The additives 7, 9, and 11 as used were of hydrate with water contents as shown in table 9, while the additives 3, 4, and 14 as used had water contents as shown in table 9.

The differentials in total acid numbers of the working examples were 0.17 to 0.29 which were smaller than that of the additive 14 of the comparative example, indicating that the additives of the present invention exhibited oxidation stabilities superior to the existing additive.

TABLE 9

| | Additive | Component (A): $R_1$ | $R_2$ | $R_3$ | Component B | Compounding molar ratio (A):(B) | Addition of surfactant | Water content in additive (wt %) | Δ total acid number (mgKOH/g) |
|---|---|---|---|---|---|---|---|---|---|
| Working example 71 | 3 | $(CH_2)_2OH$ | $(CH_2)_2OH$ | $(CH_2)_2OH$ | $CH_3(CH_2)_7CH{=}CH(CH_2)_7COOH$ | 1:1 | w/o | <1.0 | 0.17 |
| Working example 72 | 4 | $(CH_2)_2OH$ | $(CH_2)_2OH$ | $(CH_2)_2OH$ | $CH_3(CH_2)_4CH{=}CHCH_2CH{=}CH(CH_2)_7COOH$ | 1:1 | w/o | <1.0 | 0.20 |
| Working example 73 | 7 | $(CH_2)_2OH$ | $(CH_2)_2OH$ | $(CH_2)_2OH$ | $CH_2CH(OH)COOH$ | 1:1 | w/o | 19.2 | 0.17 |
| Working example 74 | 9 | $(CH_2)_2OH$ | $(CH_2)_2OH$ | $(CH_2)_2OH$ | $HOOC{-}CH(OH)CH_2{-}COOH$ | 2:1 | w/o | 7.7 | 0.29 |
| Working example 75 | 11 | $-C(CH_2OH)_3$ | H | H | $CH_2CH(OH)COOH$ | 1:1 | w/o | 14.6 | 0.20 |
| Working example 76 | 3 | $(CH_2)_2OH$ | $(CH_2)_2OH$ | $(CH_2)_2OH$ | $CH_3(CH_2)_7CH{=}CH(CH_2)_7COOH$ | 1:1 | w/ | 50.0 | 0.17 |
| Comparative example 21 | 14 | | | Polyethyleneglycol | | — | w/o | <1.0 | 0.30 |

10. Flashing Point Evaluation of Additives

The flashing points of the additive 3 of the working example and those of the additives 13, 14, and 15 of the comparative examples were measured using an automated Cleveland open cup flash point tester (aco-8 manufactured by Tanaka Scientific Limited) (Table 10).

The flashing point of the additive 3 of the working example was 195° C., which was higher than the flashing points 154 to 190° C. (literature data) of the additives 13 to 15, indicating that the additive was excellent as a lubricant.

The additives 2 and 5 to 12 forming hydrates had no flashing point because of water evaporation during heat application and thus were industrially highly useful.

TABLE 10

| | Additive | Component (A): $R_1$ | $R_2$ | $R_3$ | Component (B) | Compounding molar ratio (A):(B) | Water content in additive (wt %) | flashing point (° C.) |
|---|---|---|---|---|---|---|---|---|
| Working example 77 | 3 | $(CH_2)_2OH$ | $(CH_2)_2OH$ | $(CH_2)_2OH$ | $CH_3(CH_2)_7CH{=}CH(CH_2)_7COOH$ | 1:1 | <1.0 | 195 |
| Comparative example 22 | 13 | | | 1,2,4-butanetriol | | — | <1.0 | 188 |
| Comparative example 23 | 14 | | | polyethyleneglycol | | — | <1.0 | 190 |
| Comparative example 24 | 15 | | | paraffinic hydrocarbon | | — | <1.0 | 154 |

11. Lubricity Evaluation of Lubrication Composition (Emulsion) Containing Surfactant, Oil-Based Lubricant, and Water The additive 7 (3.0 g), a synthetic ester (3 g) as an oil-based lubricant (OTMP-300, manufactured by MIYOSHI OIL & FAT CO., LTD.), a polyoxyethylene alkylether-based non-ionic surfactant (1 g)(E-451D, manufactured by MIYOSHI OIL & FAT CO., LTD.) and water (3.0 g) were weighed in accordance with the compounding ratios as shown in table 11, and were mixed for one hour at room temperature to make a lubrication composition of the working example 78. Also, a synthetic ester (6 g) as an oil-based lubricant (OTMP-300, manufactured by MIYOSHI OIL & FAT CO., LTD.), a polyoxyethylene alkylether-based non-ionic surfactant (1 g)(E-451D, manufactured by MIYOSHI OIL & FAT CO., LTD.) and water (3.0 g) were weighted and mixed for one hour at room temperature to make a lubrication composition of the comparative example 25.

Kinetic friction coefficients 2 of the compositions of the working and comparative examples 78 and 25 were measured by a similar method as described in the section of "1. Lubricity evaluation" (Table 11).

As can be seen from the results shown in Table 11, it was confirmed that the composition of the working example 78 containing the additive 7 of the present invention had a kinetic friction coefficient that was smaller than that of the comparative example 25 having no additive 7, and that the lubrication composition containing the surfactant, oil-based lubricant and water according to the working example 78 was excellent in lubricity, thus indicating that the additive of the present invention was highly useful as an additive or base oil for a lubrication composition.

Further, by making comparisons under the same water content, it was confirmed that 70 wt % aqueous solution of additive 7 had a kinetic friction coefficient 2 that is smaller than that of the additive of the comparative example 25 (70 wt % of oil-based lubricant and surfactant). As can be seen from this result, the additive or composition of the present invention exhibited a high affinity for metal, which shows that it was superior in lubricity as an aqueous lubricant to a general emulsion-type lubrication composition containing an oil-based lubricant.

Further, the composition of the comparative example 25 (70 wt % of oil-based lubricant and surfactant) and the composition of the working example 20 (70 wt % of additive 7) were left to stand still at room temperature for 6 months. The results showed that the composition of the comparative example 25 was separated into two layers of oil and water while the composition of the working example maintained a uniform solution and was excellent in stability. Furthermore, the additives 2 and 5 to 12 of the present invention were highly soluble in water, showed no foaming due to their structural characteristics, required no special washing (for example, degreasing process) and thus are industrially highly useful, while an aqueous lubricant (emulsion) containing oil-based lubricant required washing (degreasing process) after being used as, for example, an aqueous lubricant.

TABLE 11

| | | Working example 78 | Comparative example 25 |
|---|---|---|---|
| | | Composition ratio (% by mass) | |
| Oil-based lubricant | Synthetic ester | 30 | 60 |
| Surfactant | Polyoxyethylene alkylether-based non-ionic surfactant | 10 | 10 |
| Lubricant | Additive 7 | 30 | 0 |
| Others | Water | 30 | 30 |
| Kinetic friction coefficient 2 | | 0.130 | 0.132 |

In view of the above evaluations, the additive or composition according to the present invention is excellent in lubricity, exhibits no corrosiveness on metals, is excellent in low-temperature fluidity, thermal conductivity, thermal stability, and oxidation stability, and has a high flashing point, which therefore make it suitable for use in imparting lubricity.

The invention claimed is:

1. A method for imparting lubricity on mechanical moving parts, comprising the steps of:

(a) preparing a composition by mixing at least the following components: (A) an amine or an ammonium compound; and (B) an acid or a salt of the acid, wherein at least one of the components (A) and (B) contains a hydrogen-bonding functional group, and wherein the component (A) is represented by the formula (I):

$$N[R^1]_m[R^2]_{3-m} \quad (I)$$

wherein each $R^1$ independently represents a group selected from the group consisting of a hydroxy hydrocarbon group in which there is at least one hydroxy group, wherein a hydrocarbon moiety thereof is a linear or branched moiety having 1 to 22 carbon atoms, and the hydrocarbon moiety optionally contains an oxygen atom(s);

a carboxy hydrocarbon group in which there is at least one carboxy group, wherein a hydrocarbon moiety thereof is a linear or branched moiety having 1 to 22 carbon atoms, and the hydrocarbon moiety thereof optionally contains an oxygen atom(s); and a hydroxycarboxy hydrocarbon group in which there are at least one hydroxy group and at least one carboxy group, wherein a hydrocarbon moiety thereof is a linear or branched moiety having 1 to 22 carbon atoms, and the hydrocarbon moiety thereof optionally contains an oxygen atom(s);

wherein each $R^2$ independently represents a hydrogen atom or an organic group having 1 to 22 carbon atoms, and m represents an integer of 0 to 3; or wherein the component (A) is represented by the formula (II):

$$N^+[R^3]_n[R^4]_{4-n}X^- \quad (II)$$

wherein each $R^3$ independently represents a group selected from the group consisting of a hydroxy hydrocarbon group in which there is at least one hydroxy group, wherein a hydrocarbon moiety thereof is a linear or branched moiety having 1 to 22 carbon atoms, and the hydrocarbon optionally contains an oxygen atom(s);

a carboxy hydrocarbon group in which there is at least one carboxy group, wherein a hydrocarbon moiety thereof is a linear or branched moiety having 1 to 22 carbon atoms, and the hydrocarbon moiety thereof optionally contains an oxygen atom(s); and a hydroxycarboxy hydrocarbon group in which there are at least one hydroxy group and at least one carboxy group, wherein a hydrocarbon moiety thereof is a linear or branched moiety having 1 to 22 carbon atoms, and the hydrocarbon moiety thereof optionally contains an oxygen atom(s);

wherein each $R^4$ independently represents a hydrogen atom or an organic group having 1 to 22 carbon atoms, and n represents an integer of 0 to 4; and wherein $X^-$ represents an anion, and wherein the acid of the component (B) is selected from a group consisting of a halogen-based anion, a sulfur-based anion, a phosphorus-based anion, a cyano-based anion, a fluorine-based anion, a nitrogen oxide-based anion and a carboxylic acid-based anion, and (b) applying the composition to the mechanical moving parts.

2. The method according to claim 1, wherein m is an integer of 1 to 3 in the formula (I) and n is an integer of 1 to 4 in the formula (II), and wherein $R^1$ in the formula (I) and $R^3$ in the formula (II) are each a hydroxy hydrocarbon group.

3. The method according to claim 2, wherein $R^1$ in the formula (I) and $R^3$ in the formula (II) are each a monohydroxyalkyl group.

4. The method according to claim 2, wherein $R^1$ in the formula (I) and $R^3$ in the formula (II) are each a polyhydroxyalkyl group.

5. The method according to claim 1, wherein $X^-$ in the formula (II) is a hydroxide ion.

6. A method for imparting lubricity on mechanical moving parts, comprising the steps of:

(a) preparing a composition by compounding at least the following components: (A) an amine or an ammonium compound; and (B) an acid or a salt of the acid, wherein the composition contains an organic salt formed by:

a cation originated from the component (A); and an anion originated from an anionic residue of the component (B), wherein the cation originated from the component (A) optionally contains a cationic residue of the component (B), wherein at least one of the components (A) and (B) contains a hydrogen-bonding functional group, and wherein the component (A) is represented by the formula (I):

$$N[R^1]_m[R^2]_{3-m} \quad (I)$$

wherein each $R^1$ independently represents a group selected from the group consisting of a hydroxy hydrocarbon group in which there is at least one hydroxy group, wherein a hydrocarbon moiety thereof is a linear or branched moiety having 1 to 22 carbon atoms, and the hydrocarbon moiety optionally contains an oxygen atom(s);

a carboxy hydrocarbon group in which there is at least one carboxy group, wherein a hydrocarbon moiety thereof is a linear or branched moiety having 1 to 22 carbon atoms, and the hydrocarbon moiety thereof optionally contains an oxygen atom(s); and a hydroxycarboxy hydrocarbon group in which there are at least one hydroxy group and at least one carboxy group, wherein a hydrocarbon moiety thereof is a linear or branched moiety having 1 to 22 carbon atoms, and the hydrocarbon moiety thereof optionally contains an oxygen atom(s);

wherein each $R^2$ independently represents a hydrogen atom or an organic group having 1 to 22 carbon atoms, and m represents an integer of 0 to 3; or wherein the component (A) is represented by the formula (II):

$$N^+[R^3]_n[R^4]_{4-n}X^- \quad (II)$$

wherein each $R^3$ independently represents a group selected from the group consisting of a hydroxy hydrocarbon group in which there is at least one hydroxy group, wherein a hydrocarbon moiety thereof is a linear or branched moiety having 1 to 22 carbon atoms, and the hydrocarbon optionally contains an oxygen atom(s);

a carboxy hydrocarbon group in which there is at least one carboxy group, wherein a hydrocarbon moiety thereof is a linear or branched moiety having 1 to 22 carbon atoms, and the hydrocarbon moiety thereof optionally contains an oxygen atom(s); and a hydroxycarboxy hydrocarbon group in which there are at least one hydroxy group and at least one carboxy group, wherein a hydrocarbon moiety thereof is a linear or branched moiety having 1 to 22 carbon atoms, and the hydrocarbon moiety thereof optionally contains an oxygen atom(s);

wherein each $R^4$ independently represents a hydrogen atom or an organic group having 1 to 22 carbon atoms, and n represents an integer of 0 to 4; and wherein $X^{31}$ represents an anion, and wherein the acid of the component (B) is selected from the group consisting of a halogen-based anion, a sulfur-based anion, a phosphorus-based anion, a cyano-based anion, a fluorine-based anion, a nitrogen oxide-based anion and a carboxylic acid-based anion, and (b) applying the composition to the mechanical moving parts.

7. The method according to claim 6, wherein said cation of the ammonium salt formed by the components (A) and (B) is represented by the formula (III):

$$N^+[R^5]_o[R^8]_{4-o} \quad (III)$$

wherein each $R^5$ independently represents a group selected from the group consisting of a hydroxy hydrocarbon group in which there is at least one hydroxy group, wherein a hydrocarbon moiety thereof is a linear or branched moiety having 1 to 22 carbon atoms, and the hydrocarbon moiety optionally contains an oxygen atom(s);

a carboxy hydrocarbon group in which there is at least one carboxy group, wherein a hydrocarbon moiety thereof is a linear or branched moiety having 1 to 22 carbon atoms, and the hydrocarbon moiety thereof optionally contains an oxygen atom(s); and a hydroxycarboxy hydrocarbon group in which there are at least one hydroxy group and at least one carboxy group, wherein a hydrocarbon moiety thereof is a linear or branched moiety having 1 to 22 carbon atoms, and the hydrocarbon moiety thereof optionally contains an oxygen atom(s); and wherein each $R^6$ independently represents a hydrogen atom or a linear or branched organic group having 1 to 22 carbon atoms, and o represents an integer of 0 to 4.

8. The method according to claim 7, wherein m is an integer of 1 to 3 in the formula (I), n is an integer of 1 to 4 in the formula (II), and o in the formula (III) is an integer of 1 to 4, and wherein $R^1$ in the formula (I), $R^3$ in the formula (II), and $R^5$ in the formula (III) are each a hydroxy hydrocarbon group.

9. The method according to claim 8, wherein $R^1$ in the formula (I), $R^3$ in the formula (II), and $R^5$ in the formula (III) are each a monohydroxyalkyl group.

10. The method according to claim 8, wherein $R^1$ in the formula (I), $R^3$ in the formula (II), and $R^5$ in the formula (III) are each a polyhydroxyalkyl group.

11. The method according to claim 1, wherein a mixture or salt of the components (A) and (B) of anhydride or hydrate has a coagulation point of less than 25° C.

12. The method according to claim 1, wherein the composition is prepared by further mixing water, and the composition is aqueous.

13. The method according to claim 1, wherein the composition is prepared by further mixing a surfactant.

14. The method according to claim 1, wherein the composition is prepared by further mixing a surfactant and water.

15. The method according to claim 1, wherein the composition is prepared by further mixing a surfactant and an oil-based lubricant, and optionally water.

16. The method according to claim 1, wherein said mechanical moving parts are both made of metal or metal alloy.

17. The method according to claim 1, wherein said composition is a hydraulic oil, a bearing oil, a gear oil or a brake or clutch fluid.

18. The method according to claim 1, wherein friction and/or heat in said mechanical moving parts is reduced by use of said composition.

19. The method according to claim 17, wherein friction and/or heat in said mechanical moving parts associated with said hydraulic oil, bearing oil, gear oil or brake or clutch fluid is reduced by use of said composition.

20. The method according to claim 1, wherein said composition is used for metallic processing, and friction and/or heat in said mechanical moving parts associated with said metallic processing is reduced by use of said composition.

21. The method according to claim 3, wherein the component (A) is represented by the formula (I), the monohydroxyalkyl group has 1 to 6 carbon atoms, and $R^2$ represents a hydrogen atom or an alkyl group having 1 to 4 carbon atoms.

22. The method according to claim 21, wherein the acid of the component (B) is selected from the group consisting of a sulfur-based anion, a phosphorus-based anion and a carboxylic acid-based anion.

23. The method according to claim 4, wherein the component (A) is represented by the formula (I), and the polyhydroxyalkyl group is selected from the group consisting of:

a branched polyhydroxyalkyl group represented by the following formula:

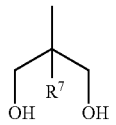

wherein $R^7$ represents a hydrogen atom, a linear alkyl group having 1 to 4 carbon atoms, or a linear hydroxyalkyl group having 1 to 4 carbon atoms; and a linear polyhydroxyalkyl group having 2 to 8 hydroxy groups.

24. The method according to claim 23, wherein the $R^2$ in the formula (I) is a hydrogen atom.

25. The method according to claim 24, wherein the acid of the component (B) is selected from the group consisting of a sulfur-based anion, a phosphorus-based anion and a carboxylic acid-based anion.

26. The method according to claim 9, wherein the component (A) is represented by the formula (I), the monohydroxyalkyl group has 1 to 6 carbon atoms, and $R^2$ and $R^6$ represent a hydrogen atom or an alkyl group having 1 to 4 carbon atoms.

27. The method according to claim 26, wherein the acid of the component (B) is selected from the group consisting of a sulfur-based anion, a phosphorus-based anion and a carboxylic acid-based anion.

28. The method according to claim 10, wherein the component (A) is represented by the formula (I), and the polyhydroxyalkyl group is selected from the group consisting of:

a branched polyhydroxyalkyl group represented by the following formula:

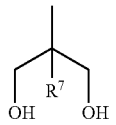

wherein $R^7$ represents a hydrogen atom, a linear alkyl group having 1 to 4 carbon atoms, or a linear hydroxyalkyl group having 1 to 4 carbon atoms; and a linear polyhydroxyalkyl group having 2 to 8 hydroxy groups.

29. The method according to claim 28, wherein $R^2$ in the formula (I) and $R^6$ in the formula (III) are each hydrogen atoms.

30. The method according to claim 29, wherein the acid of the component (B) is selected from the group consisting of a sulfur-based anion, a phosphorus-based anion and a carboxylic acid-based anion.

* * * * *